US010514638B2

(12) United States Patent
Matsuura

(10) Patent No.: US 10,514,638 B2
(45) Date of Patent: Dec. 24, 2019

(54) FIXING DEVICE THAT CONTROLS ENERGIZATION TO A HEATING PORTION, USING AT LEAST ONE SENSOR, WHEN A RECORDING MATERIAL IS AN ENVELOPE OF A PREDETERMINED WIDTH OR MORE

(71) Applicant: CANON KABUSHIKI KAISHA, Tokyo (JP)

(72) Inventor: Daigo Matsuura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/217,610

(22) Filed: Dec. 12, 2018

(65) Prior Publication Data

US 2019/0187594 A1 Jun. 20, 2019

Related U.S. Application Data

(63) Continuation of application No. PCT/JP2017/023114, filed on Jun. 16, 2017.

(30) Foreign Application Priority Data

Jun. 17, 2016 (JP) ..... 2016-120429

(51) Int. Cl.
*G03G 15/20* (2006.01)

(52) U.S. Cl.
CPC ..... *G03G 15/2039* (2013.01); *G03G 15/20* (2013.01)

(58) Field of Classification Search
CPC ..... G03G 15/2039; G03G 15/20
USPC ..... 399/45, 69
See application file for complete search history.

(56) References Cited

U.S. PATENT DOCUMENTS

| | | | | |
|---|---|---|---|---|
| 7,907,870 | B2 | 3/2011 | Haseba et al. | |
| 8,050,577 | B2 | 11/2011 | Choi | |
| 8,953,966 | B2 | 2/2015 | Hase et al. | |
| 2009/0232534 | A1* | 9/2009 | Haseba | G03G 15/2039 399/69 |
| 2010/0172661 | A1 | 7/2010 | Choi | |

(Continued)

FOREIGN PATENT DOCUMENTS

| | | | |
|---|---|---|---|
| JP | 2002-023556 | A | 1/2002 |
| JP | 2009-223044 | A | 10/2009 |
| JP | 2013-148721 | A | 8/2013 |

(Continued)

OTHER PUBLICATIONS

International Search Report and Written Opinion dated Aug. 29, 2017, issued in corresponding International Patent Application No. PCT/JP2017/023114.

*Primary Examiner* — Sophia S Chen
(74) *Attorney, Agent, or Firm* — Venable LLP

(57) ABSTRACT

A fixing device includes a first rotatable member and a second rotatable member for forming a nip for fixing a toner image on a recording material, a heating portion for heating the first rotatable member, a first sensor for detecting a temperature of a longitudinally central portion of the first rotatable member, a second sensor for detecting a temperature of one longitudinal end portion of the first rotatable member, and a controller for controlling energization to the heating portion using a detection temperature of the first sensor and a detection temperature of the second sensor in a case that the recording material is an envelope having a predetermined width or more.

11 Claims, 22 Drawing Sheets

(56) References Cited

U.S. PATENT DOCUMENTS

| | | | | |
|---|---|---|---|---|
| 2014/0029968 | A1 | 1/2014 | Tamaki | |
| 2015/0043930 | A1 * | 2/2015 | Matsuura ..... | G03G 15/2039 399/45 |

FOREIGN PATENT DOCUMENTS

| | | | |
|---|---|---|---|
| JP | 2014-025965 | A | 2/2014 |
| WO | 2017/217558 | A1 | 12/2017 |

* cited by examiner

PRIOR ART

PRIOR ART

FIXING DEVICE THAT CONTROLS ENERGIZATION TO A HEATING PORTION, USING AT LEAST ONE SENSOR, WHEN A RECORDING MATERIAL IS AN ENVELOPE OF A PREDETERMINED WIDTH OR MORE

This application is a continuation of International Patent Application No. PCT/JP2017/023114, filed Jun. 6, 2017, which claims the benefit of Japanese Patent Application No. 2016-120429, filed on Jun. 17, 2016, both of which are hereby incorporated by reference in their entireties.

TECHNICAL FIELD

The present invention relates to a fixing device for fixing a toner image on a recording material.

BACKGROUND ART

Conventionally, in a fixing device, the toner image (unfixed image) formed on the recording material (hereafter referred to as a sheet or paper) is subjected to a fixing process by heat and pressure.

In the market, image formation on an envelope as the recording material has been desired. For example, in a device described in Japanese Laid-Open Patent Application 2014-025965, in order to prevent generation of a crease on the envelope, a constitution in which a pressure is made small compared with when an ordinary recording material, such as plain paper, is used, is employed.

Here, the envelope is a recording material that has a bag shape such that two sheets are partly pasted, or the like, and in which a thick portion and a thin portion exist in mixture. For example, an envelope that is called Choukei 3 you includes one that is laminated at a central portion of a short side and is pasted (central bonding), and one that is laminated at an end portion of the short side and is pasted (end bonding). The laminated portion requires a margin (tab) for pasting, and, therefore, is configured so that three sheets are partly superposed.

At such a laminated portion, compared with a thin portion where the sheets are not laminated, much heat of the fixing device is taken. As a result, there is a liability that a heat quantity is insufficient and unfixed toner cannot be sufficiently fixed, so that there is room for improvement.

SUMMARY OF INVENTION

According to one aspect, the present invention provides a fixing device comprising first and second rotatable members for forming a nip for fixing a toner image on a recording material, a heating portion for heating the first rotatable member, a first sensor for detecting a temperature of a longitudinally central portion of the first rotatable member, a second sensor for detecting a temperature of one longitudinal end portion of the first rotatable member, and a controller for controlling energization to the heating portion using a detection temperature of the first sensor and a detection temperature of the second sensor in a case that the recording material is an envelope with a predetermined width or more.

According to another aspect, the present invention provides a fixing device comprising first and second rotatable members for forming a nip for fixing a toner image on a recording material, a heating portion for heating the first rotatable member, a first sensor for detecting a temperature of a longitudinally central portion of the first rotatable member, a second sensor for detecting a temperature of one longitudinal end portion of the first rotatable member, a third sensor for detecting a temperature of the other longitudinal end portion of the first rotatable member, and a selecting portion for selecting either one of the first sensor, the second sensor, and the third sensor as a sensor to be used for energization control to the heating portion, depending on detection temperatures of the first sensor, the second sensor, and the third sensor in a case that the recording material is an envelope with a predetermined width or more.

Figure 7:
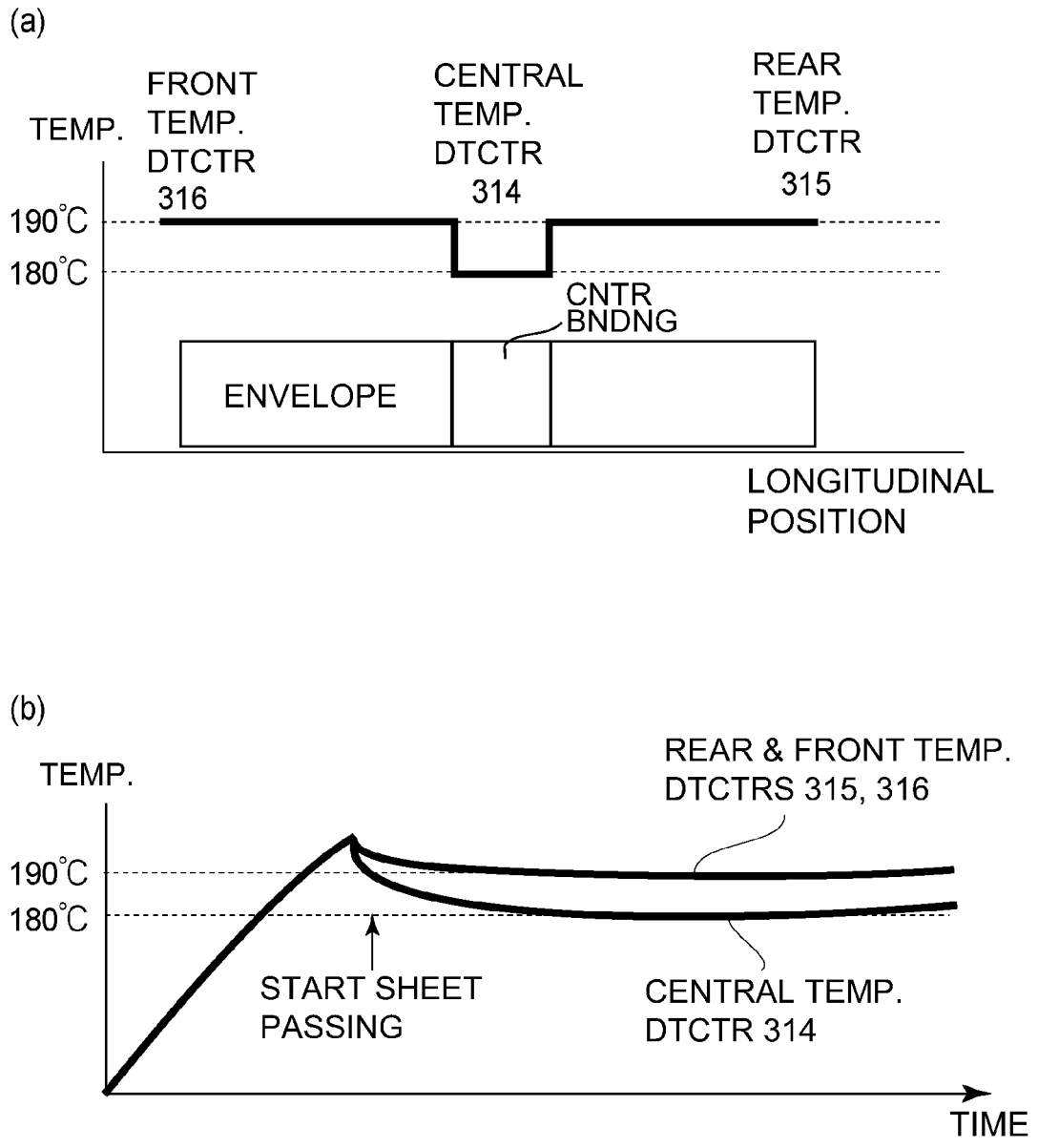

Parts (a) and (b) of FIG. 7 include schematic views for illustrating a temperature distribution and a temperature change, respectively, of a fixing roller in the fixing device of Embodiment 1.

Figure 8:
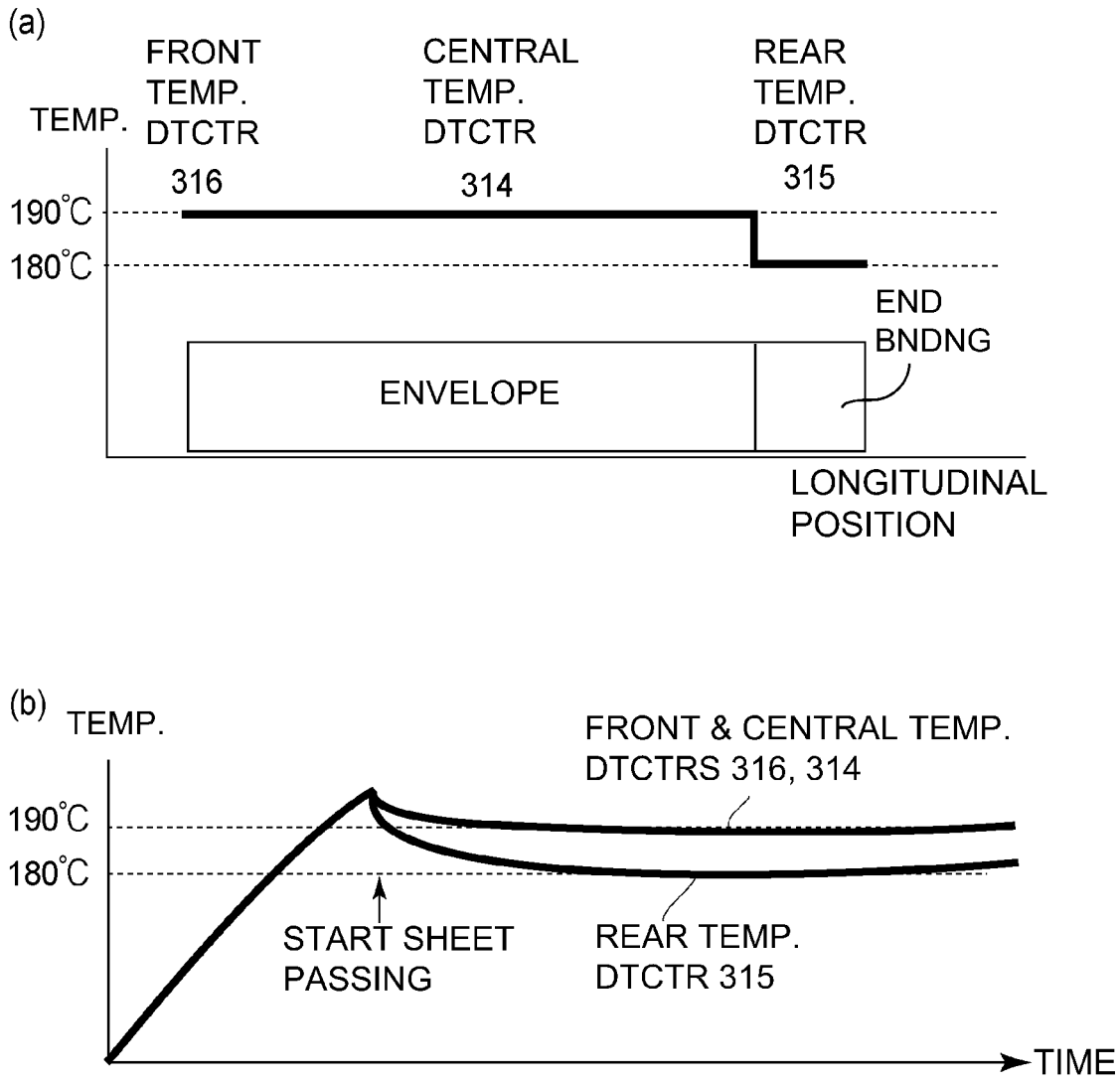

Parts (a) and (b) of FIG. 8 include schematic views for illustrating a temperature distribution and a temperature change, respectively, of the fixing roller in the fixing device of Embodiment 1.

Figure 9:
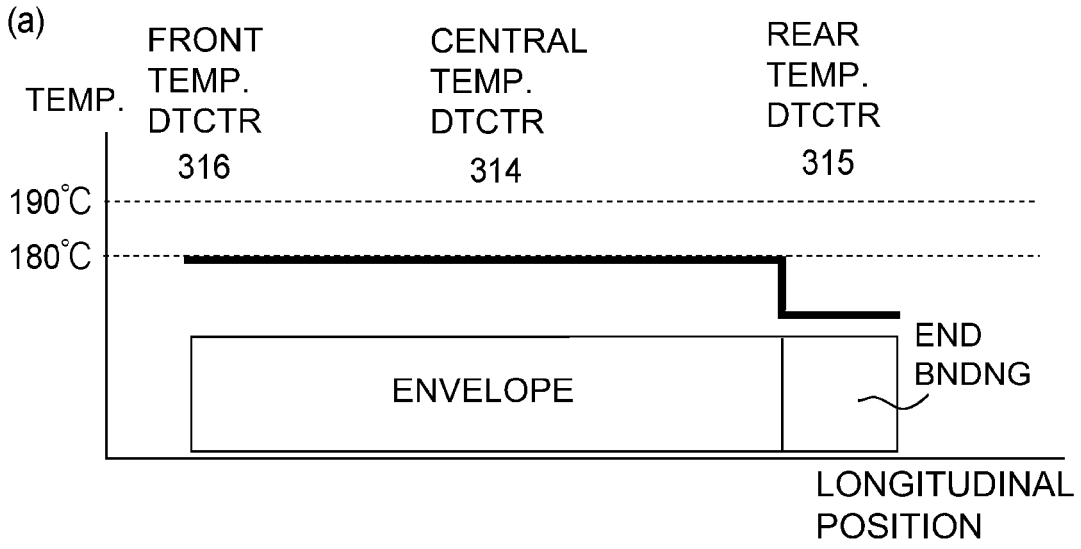
Figure 9:
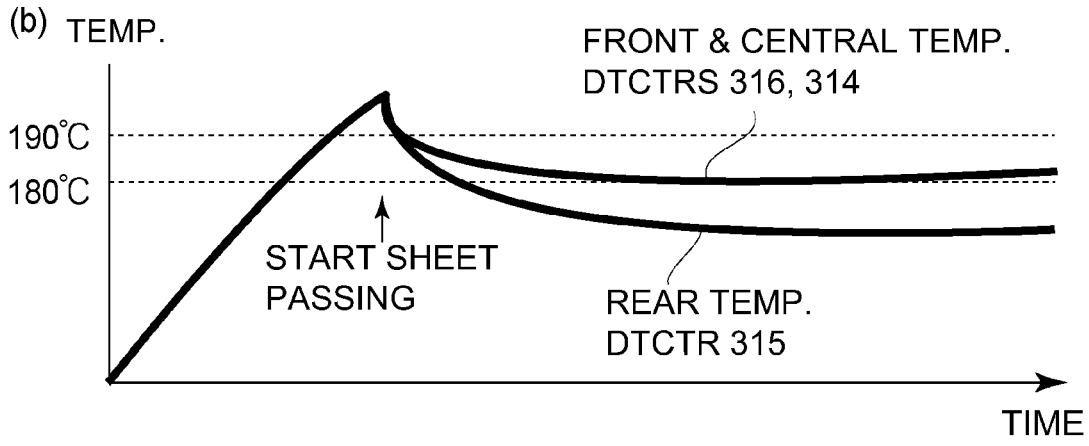

Parts (a) and (b) of FIG. 9 include schematic views for illustrating a temperature distribution and a temperature change, respectively, of a fixing roller in a fixing device of Comparison Example 1.

Figure 10:
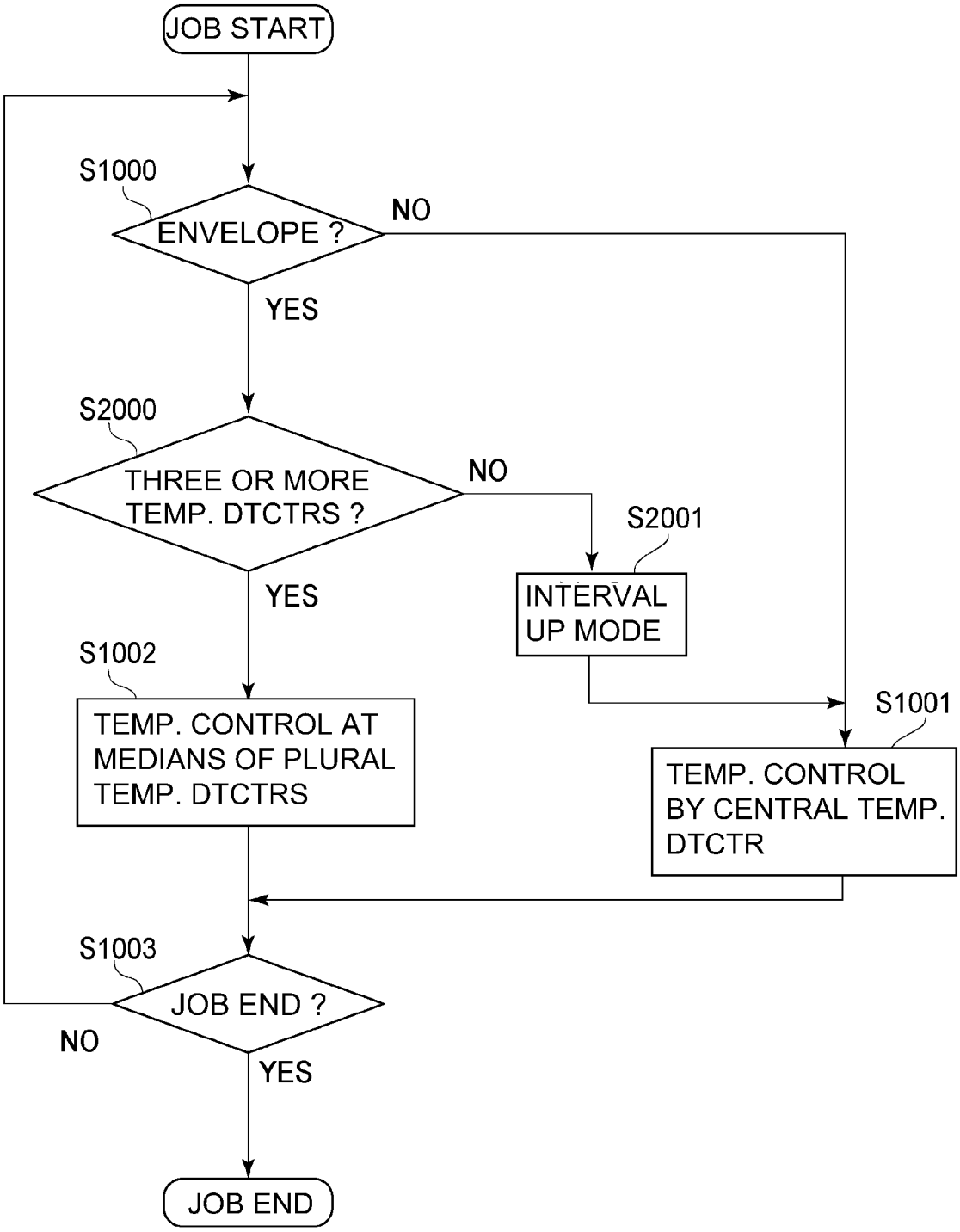

FIG. 10 is a flowchart of control in Embodiment 2.

Figure 11:
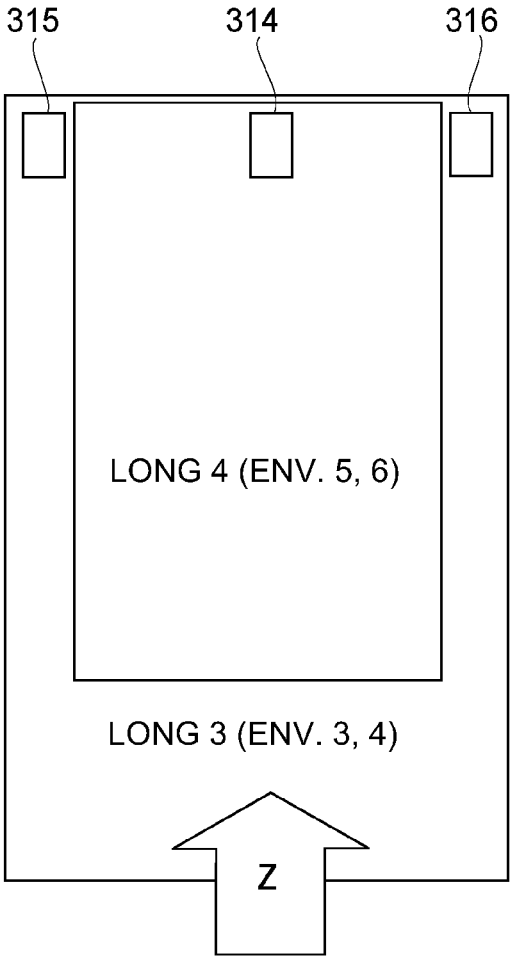

FIG. 11 is a schematic view for illustrating an operation of Embodiment 2.

Figure 12:
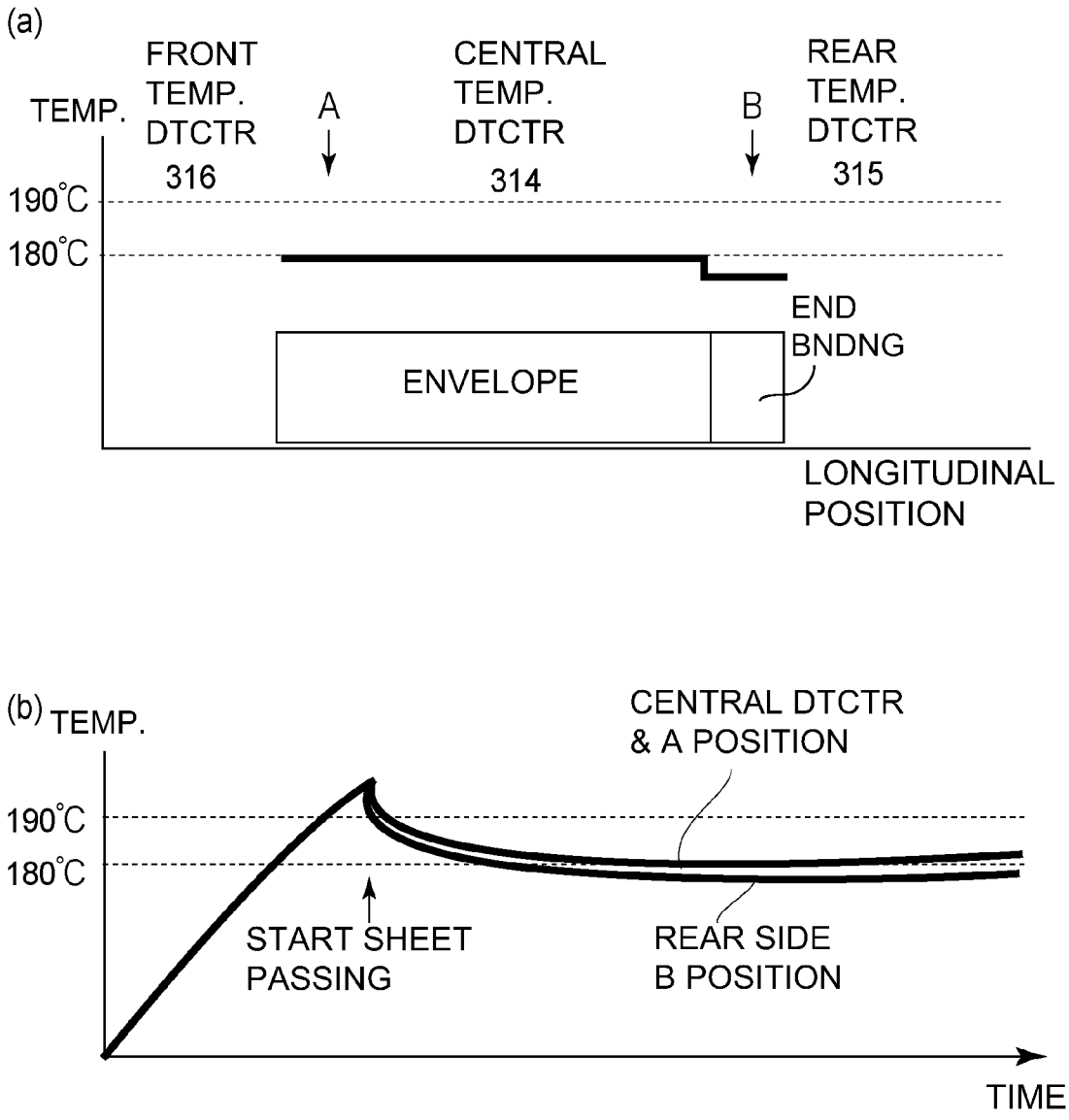

Parts (a) and (b) of FIG. 12 include schematic views for illustrating a temperature distribution and a temperature change, respectively, of a fixing roller in a fixing device of Embodiment 2.

Figure 13:
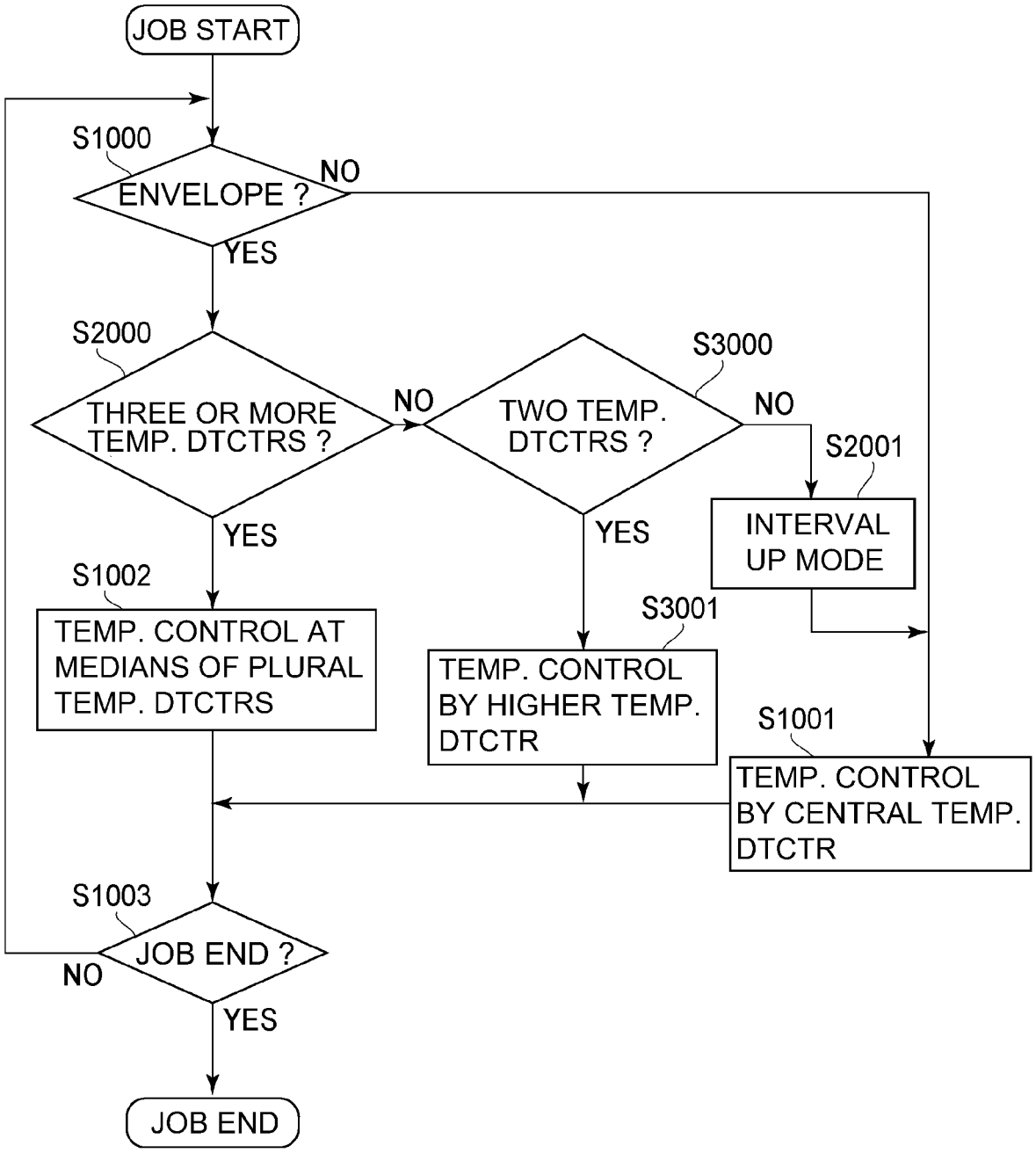

FIG. 13 is a flowchart of control in Embodiment 3.

Figure 14:
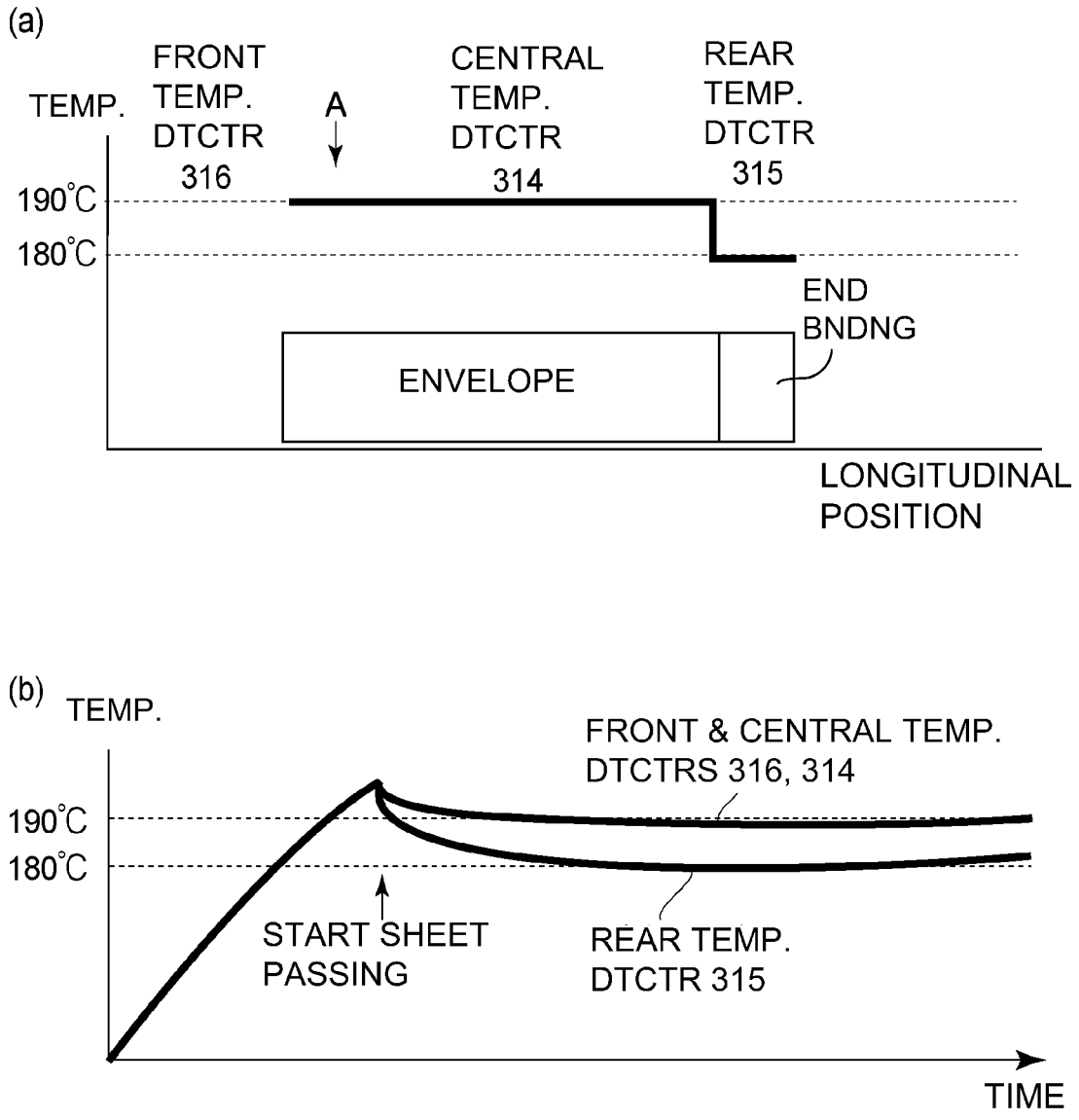

Parts (a) and (b) of FIG. 14 include schematic views for illustrating a temperature distribution and a temperature change, respectively, of a fixing roller in a fixing device of Embodiment 3.

Figure 15:
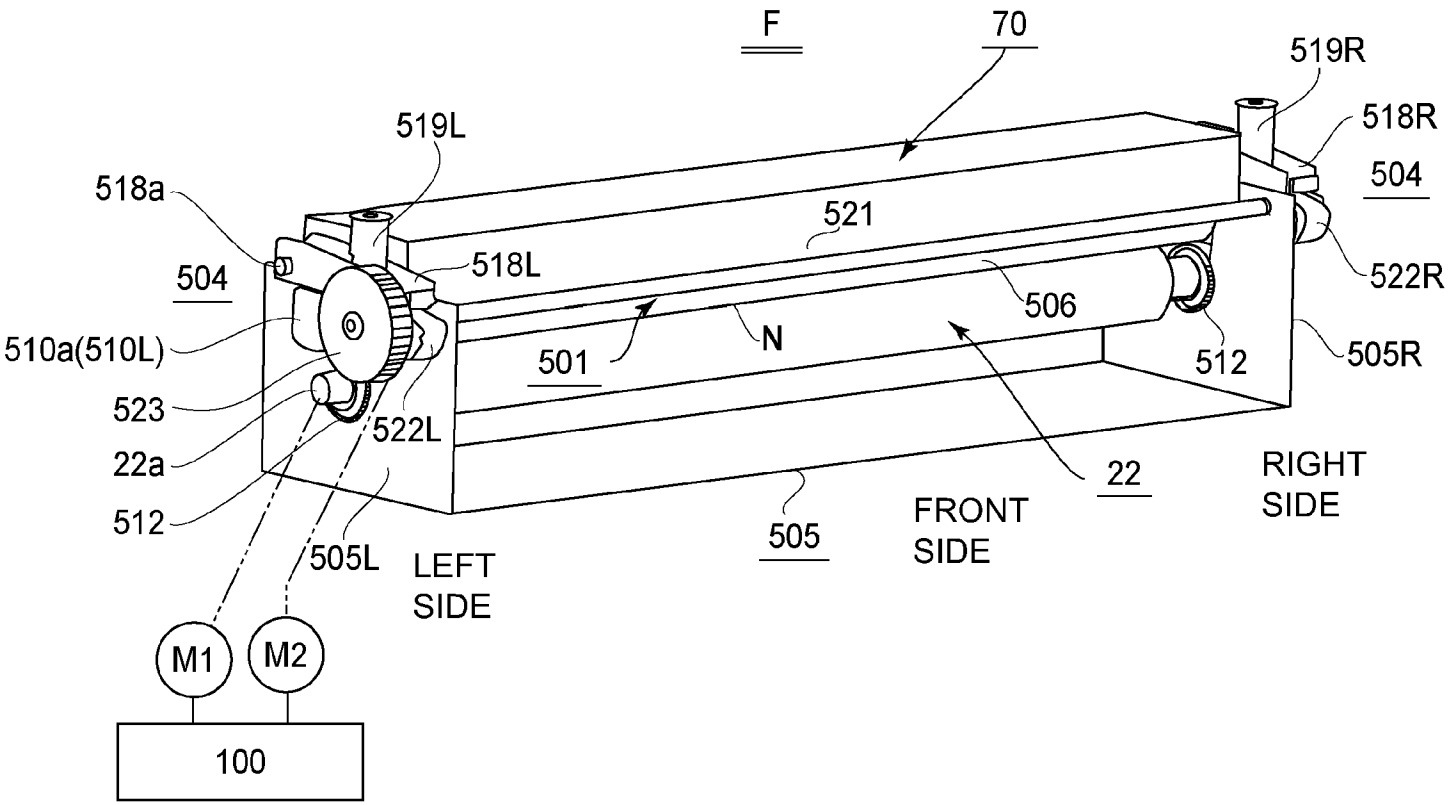

FIG. 15 is a perspective view of a fixing device of Embodiment 4.

Figure 16:
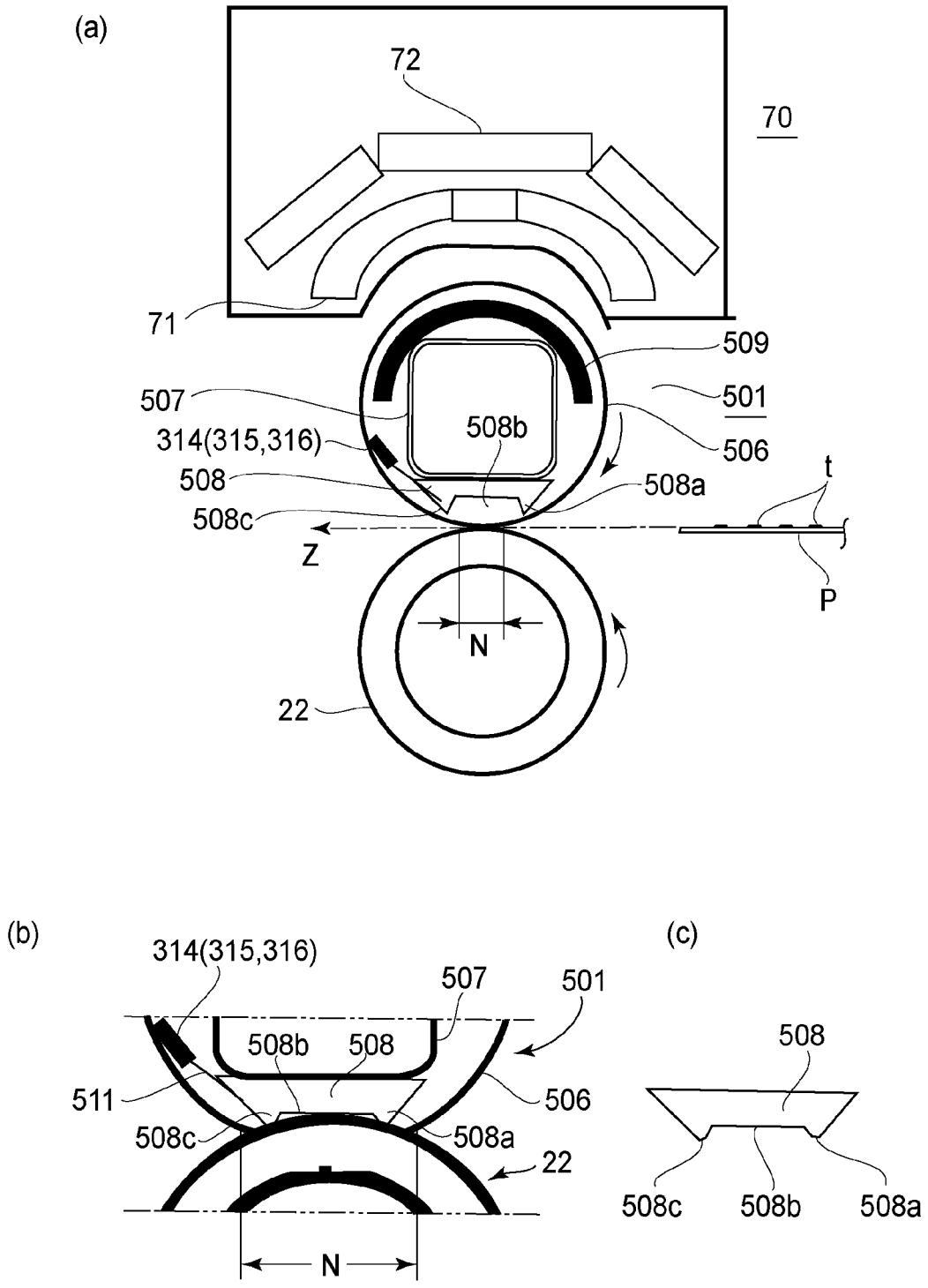

Part (a) of FIG. 16 is a schematic view of a cross-sectional left-side surface of a principal part of the fixing device, part (b) of FIG. 16 is a partially enlarged view of part (a) of FIG. 16, and part (c) of FIG. 16 is a cross-sectional view of a pressure applying member (pressing pad).

Figure 17:
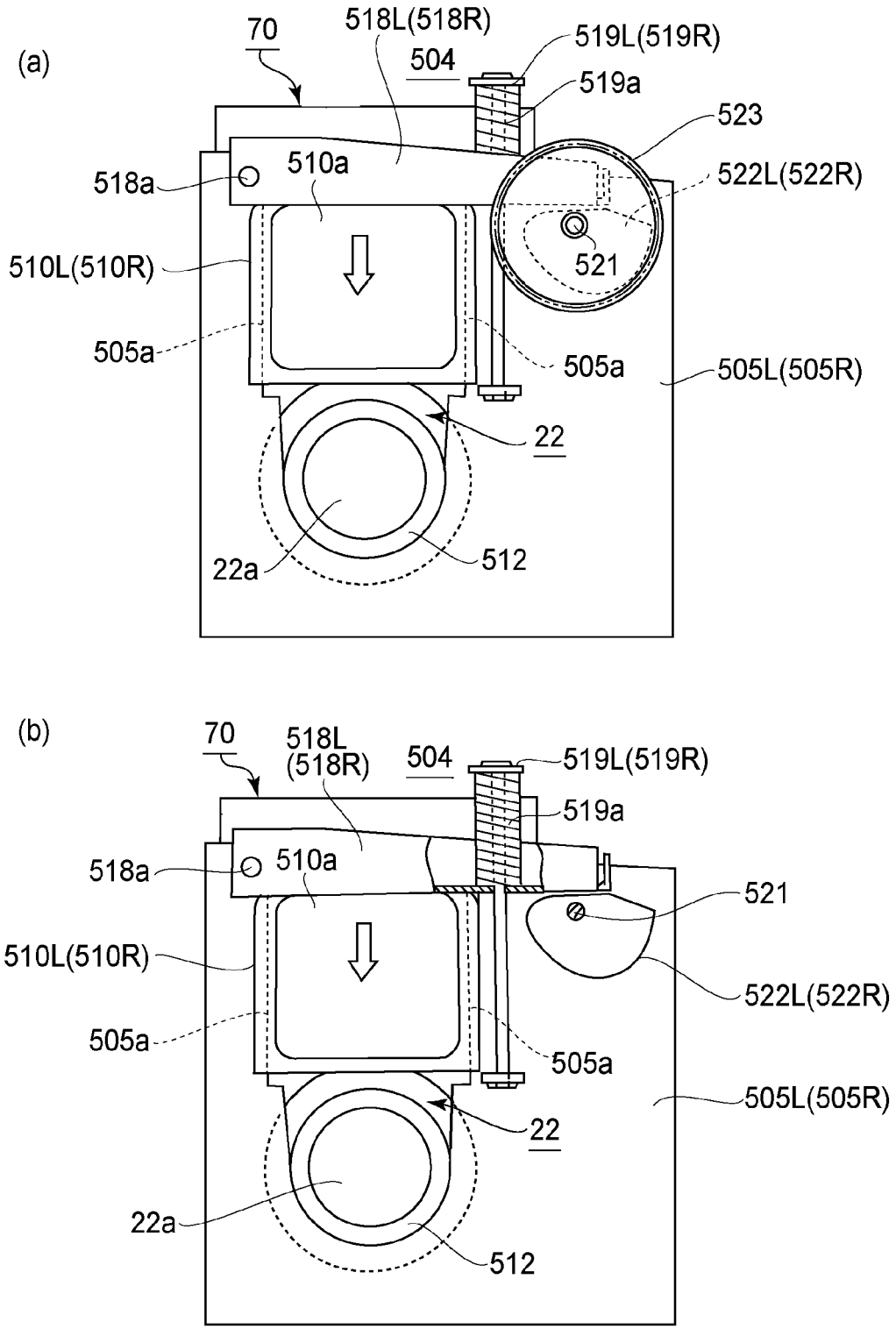

Parts (a) and (b) of FIG. 17 are a left-side surface view of the fixing device and a left-side surface view of the fixing device, respectively, which is partly cut away.

Figure 18:
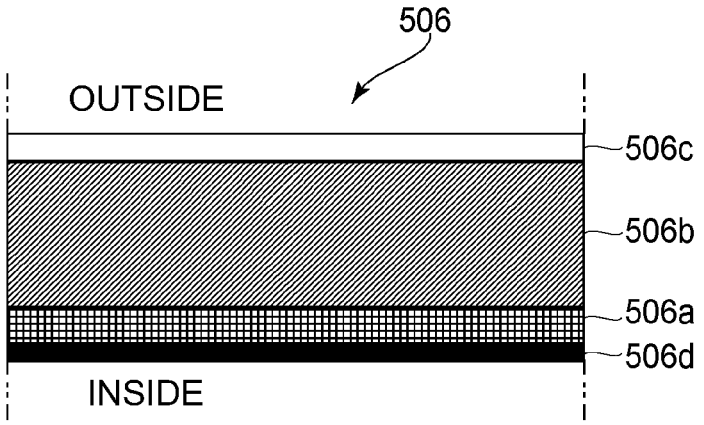

FIG. 18 is a schematic view of a layer structure of a fixing belt.

Figure 19:
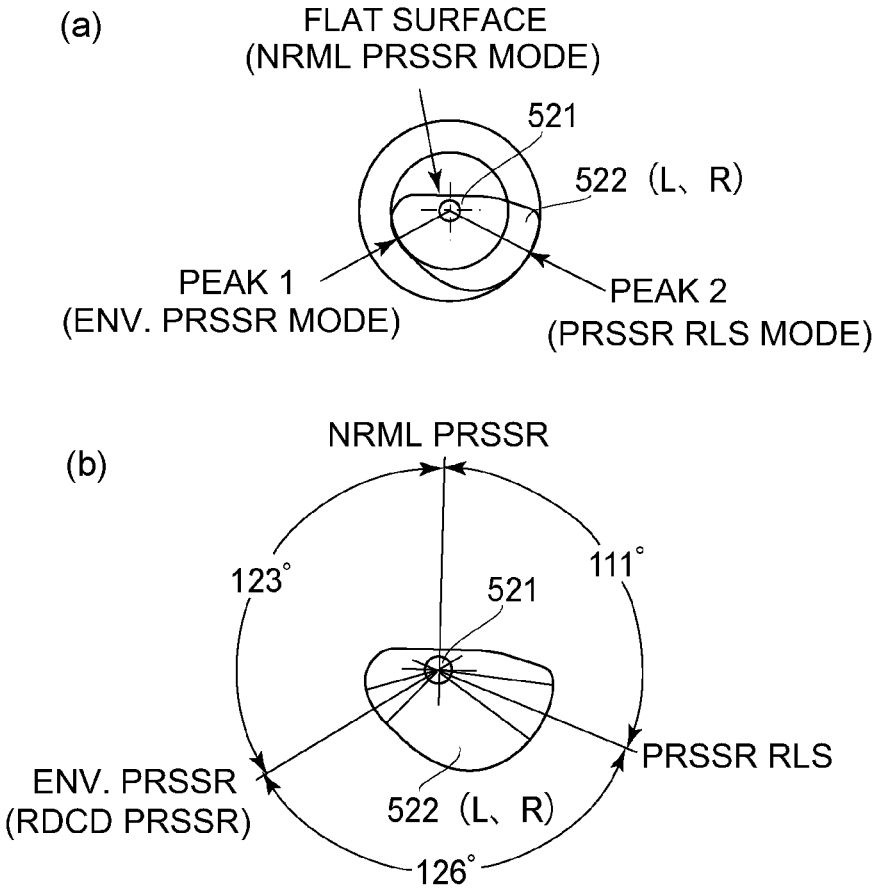

Parts (a) and (b) of FIG. 19 are illustrations of a shape of an eccentric cam.

Figure 20:
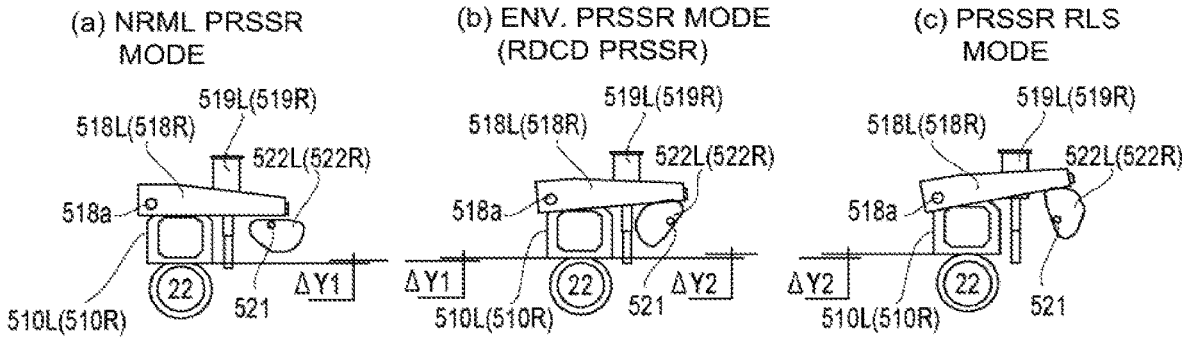

Parts (a) to (c) of FIG. 20 include illustrations of a belt unit position in each of pressure modes.

Figure 21:
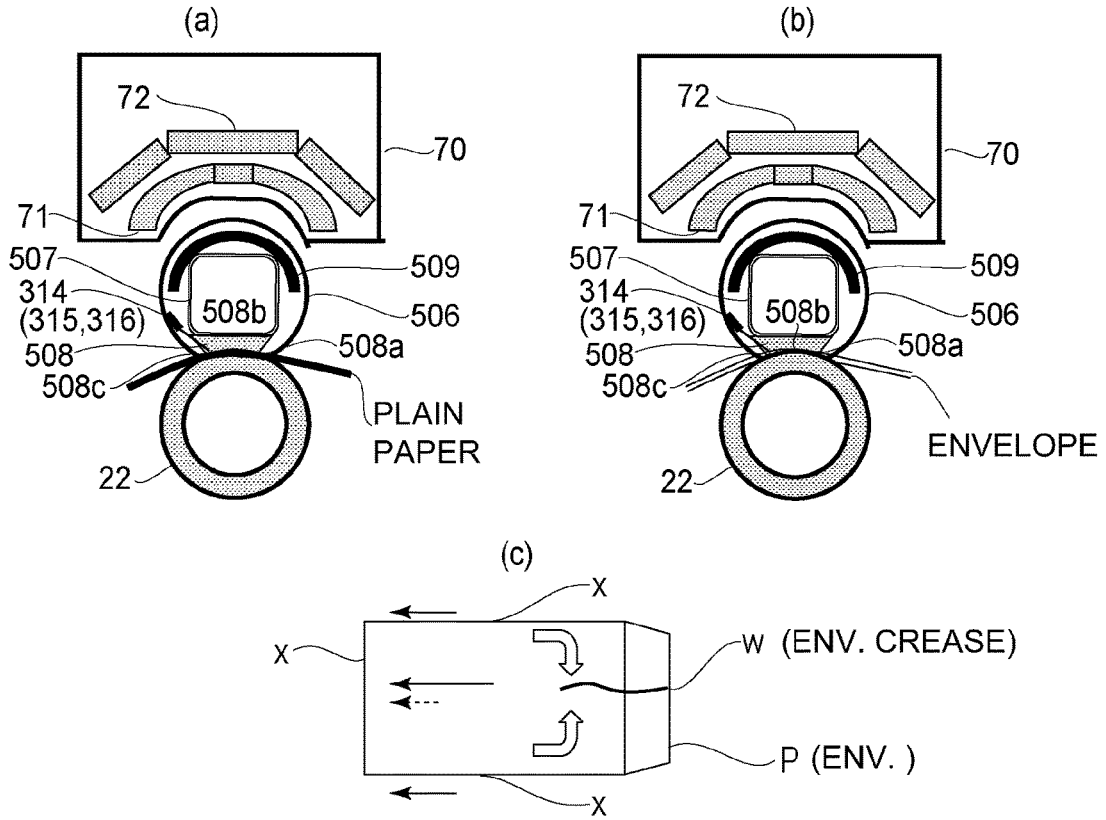

Parts (a) to (c) of FIG. 21 include illustrations in a normal pressure mode.

Figure 22:
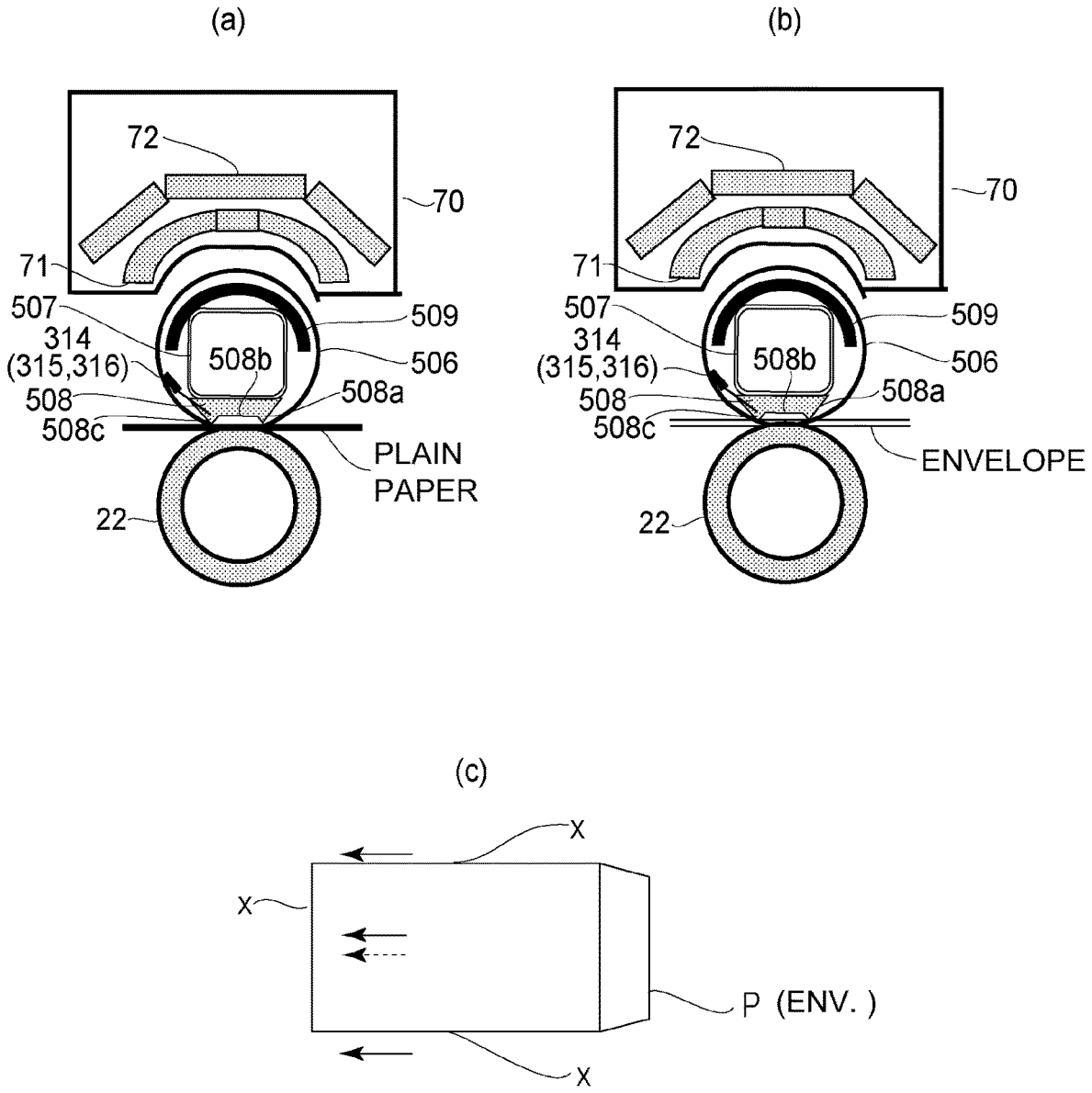

Parts (a) to (c) of FIG. 22 include illustrations in an envelope pressure mode.

Figure 23:
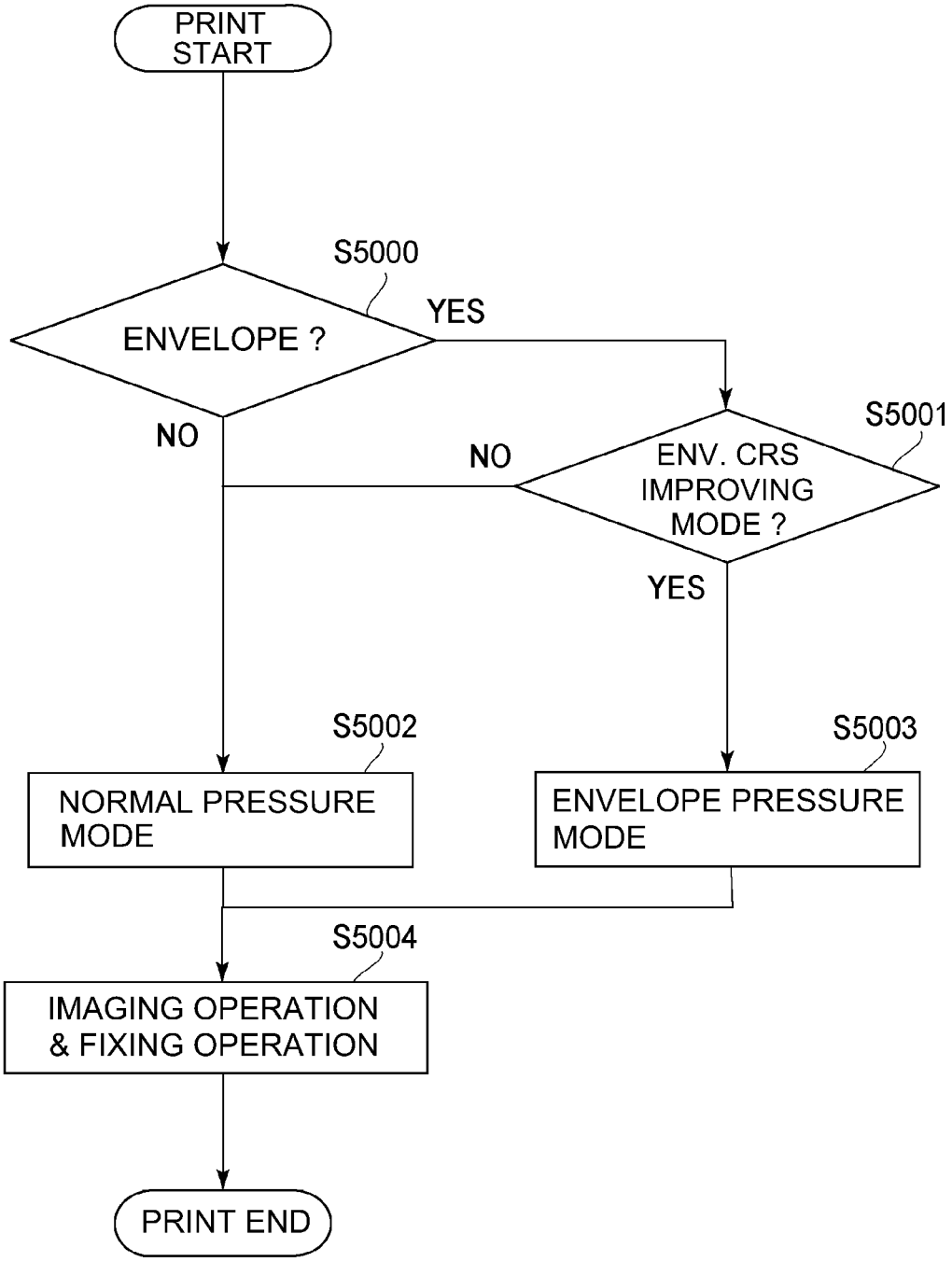

FIG. 23 is part 1 of a flowchart of control in Embodiment 4.

Figure 24:
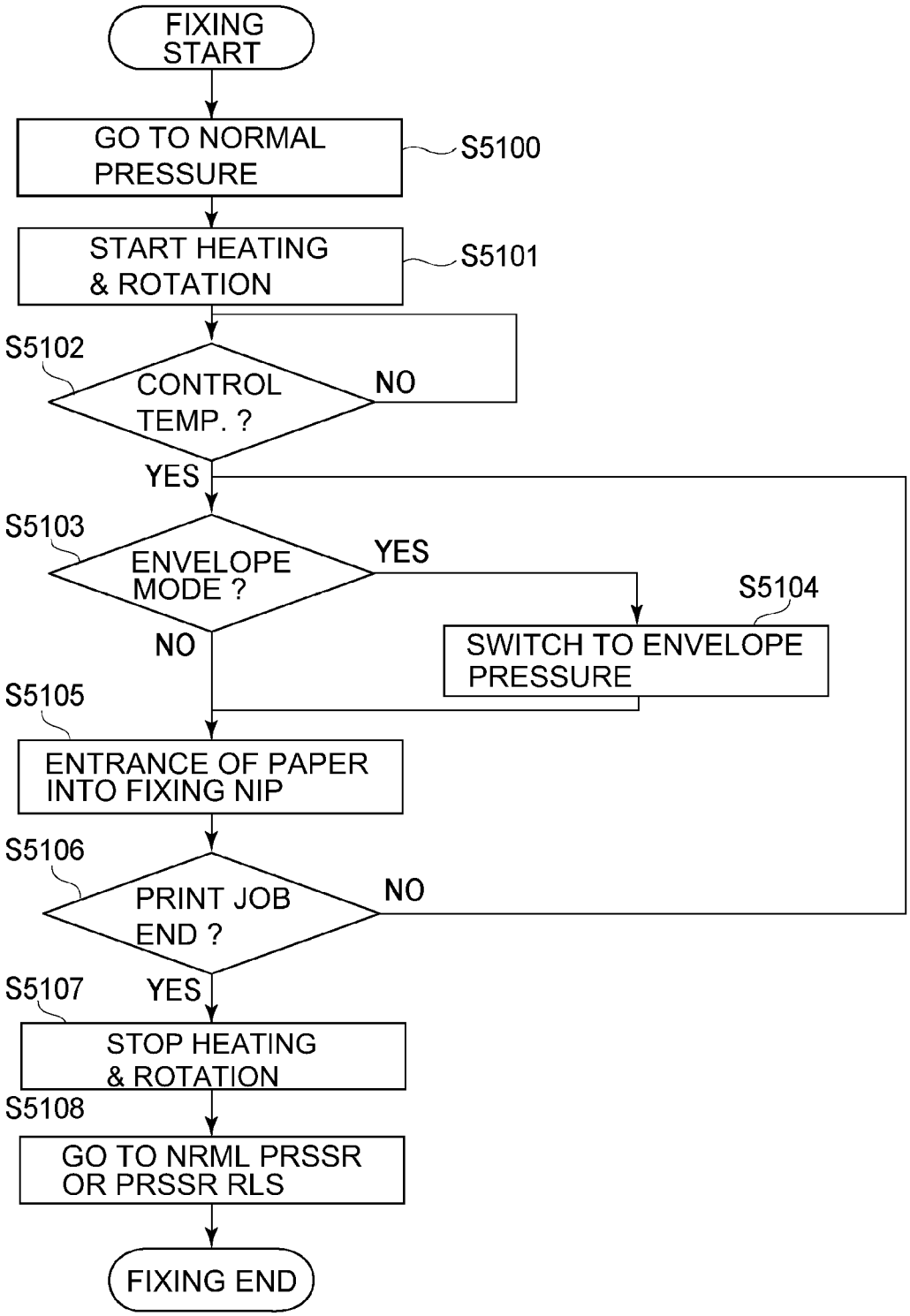

FIG. 24 is part 2 of the flowchart control in Embodiment 4.

Figure 25:
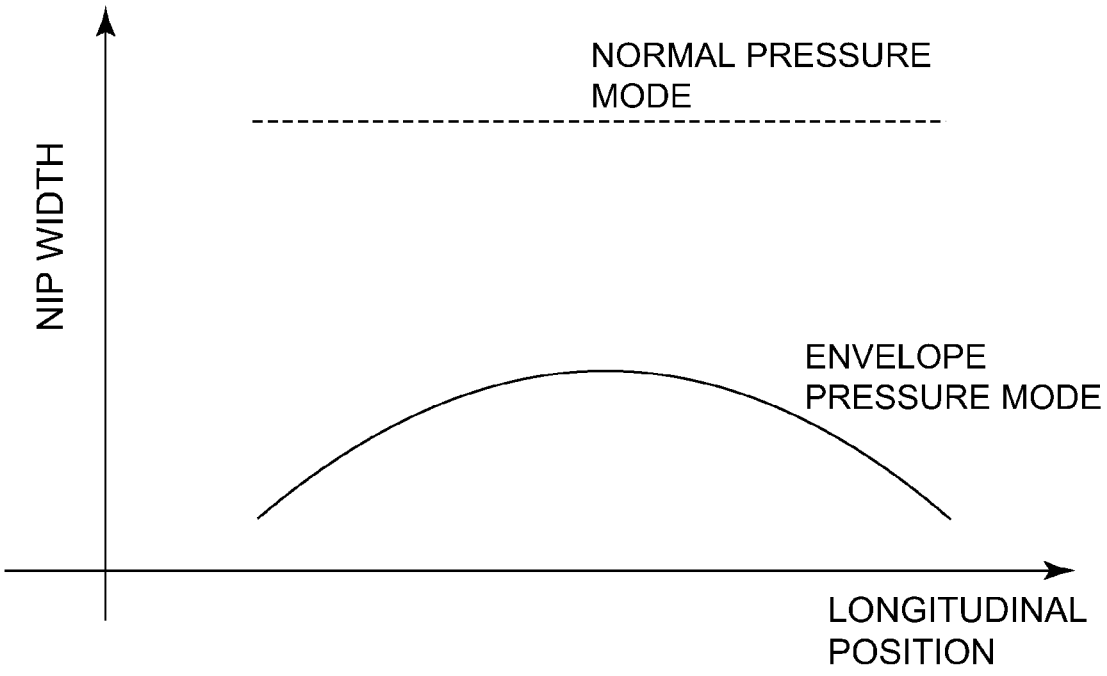

FIG. 25 is a view for illustrating a nip width in the normal pressure mode and in the envelope pressure mode.

EMBODIMENTS FOR CARRYING OUT THE INVENTION

In the following description, embodiments of the present invention will be described specifically with reference to the drawings. The present invention can also be carried out in other embodiments in which a part or all of the constitutions of the embodiments (of the present invention) are replaced with alternative constitutions thereof, as long as productivity of a recording material is set depending on a detection temperature difference of a plurality of temperature detecting elements.

Accordingly, an image heating device (image heating apparatus, or fixing portion) includes not only a fixing device for fixing a toner image on a recording material by heat-processing the recording material, on which an unfixed toner image is formed, but also a surface treating device for imparting a desired surface property to an image by heat-processing a half-fixed or a fixed toner image. A rotatable member, which is subjected to induction heating, and a rotatable member, which is to be press-contacted, include not only rollers but also belts and films.

An image forming apparatus in which the image heating device is mounted is capable of carrying out the present invention without distinction of monochromatic/full-color, sheet-feeding type/recording material-feeding type/intermediary transfer type, a toner image forming type, and a transfer type. In this embodiment, only a main portion relating to formation/transfer/fixing of the toner image will be described, but the present invention is capable of being carried out in image forming apparatuses in various uses, such as printers, various printing machines, copying machines, FAX, multi-function machines, and the like.

Image Forming Apparatus

Figure 2:
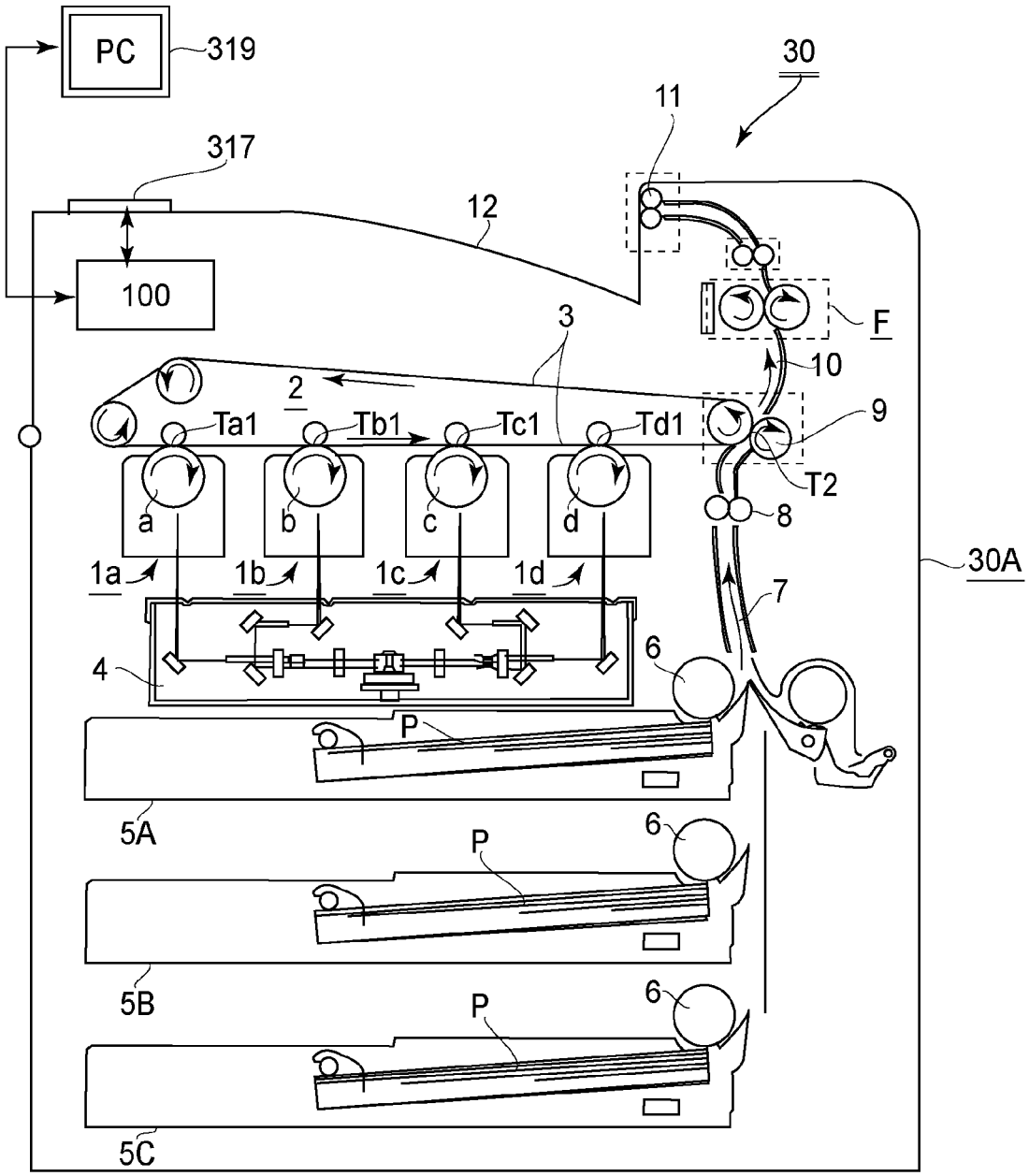
FIG. 2 is a structural illustration of an example of an image forming apparatus.

FIG. 2 is a structural illustration of the image forming apparatus 30 in this embodiment. This image forming apparatus 30 is an electrophotographic full-color printer of a tandem type-intermediary transfer type, and performs an image forming operation on the basis of an image forming job (print job) input from an external device 319 to a controller (control portion) 100. A printer operating portion 317 is capable of inputting various pieces of information to the controller 100. Further, on a display portion of the operating portion 317, display of various pieces of information from the controller 100 is carried out.

Inside a printer main assembly 30A, four image forming portions 1*a*, 1*b*, 1*c*, and 1*d* are provided. The respective image forming portions 1*a*, 1*b*, 1*c*, and 1*d* include photosensitive drums a, b, c, and d, and process means, actable on the photosensitive drums, such as charging devices, developing devices, drum cleaners, and the like (all are not shown). On an upper side of these image forming portions 1*a*, 1*b*, 1*c*, and 1*d*, an intermediary transfer belt unit 2 is provided, including an intermediary transfer belt 3, and, below a lower side of these image forming portions 1*a*, 1*b*, 1*c*, and 1*d*, a laser scanner unit 4 is provided.

At the image forming portion 1*a*, a yellow toner image is formed on the photosensitive drum a, and is then transferred onto the intermediary transfer belt 3 at a primary transfer portion Ta1. At the image forming portion 1*b*, a magenta toner image is formed on the photosensitive drum b, and is then transferred onto the intermediary transfer belt 3 at a primary transfer portion Tb1. At the image forming portions 1*c* and 1*d*, a cyan toner image and a black toner image are formed on the photosensitive drum c and the photosensitive drum d, respectively, and are then transferred onto the intermediary transfer belt 3 at a primary transfer portions Tc1 and Td1, respectively. As a result, four-color superposed toner images are formed on the intermediary transfer belt 3. Electrophotographic process mechanisms and image forming operations of these image forming portions are well known, and, therefore, a description thereof will be omitted.

On the other hand, a feeding roller 6 of either of a plurality of stages of recording material cassettes 5 (A, B, C) is driven, and one of recording materials (sheets, or, hereafter referred to as sheets or papers) P is fed. The sheet P passes through a feeding path 7 and is introduced into a secondary transfer portion T2 that is a press-contact portion of the intermediary transfer belt 3 and a secondary transfer roller 9 at predetermined control timing by a registration roller pair 8. By this arrangement, the four-color superposed toner images on the intermediary transfer belt 3 are secondary-transferred altogether onto the sheet P.

The sheet P passes through a feeding path 10 and is introduced into a fixing device (fixing portion) F, which is an image heating device, and is heated and pressed, so that an unfixed toner image is melted and softened and is fixed (heat-fixed) as a fixed image. The sheet P coming out of the fixing device F is discharged onto an upper tray 12 by a discharging roller 11. Here, in the printer 30 of this embodiment, feeding of sheets of large and small sizes, i.e., various width sizes, is made on a so-called center (line) basis with a sheet width center.

Fixing Device

Figure 3:
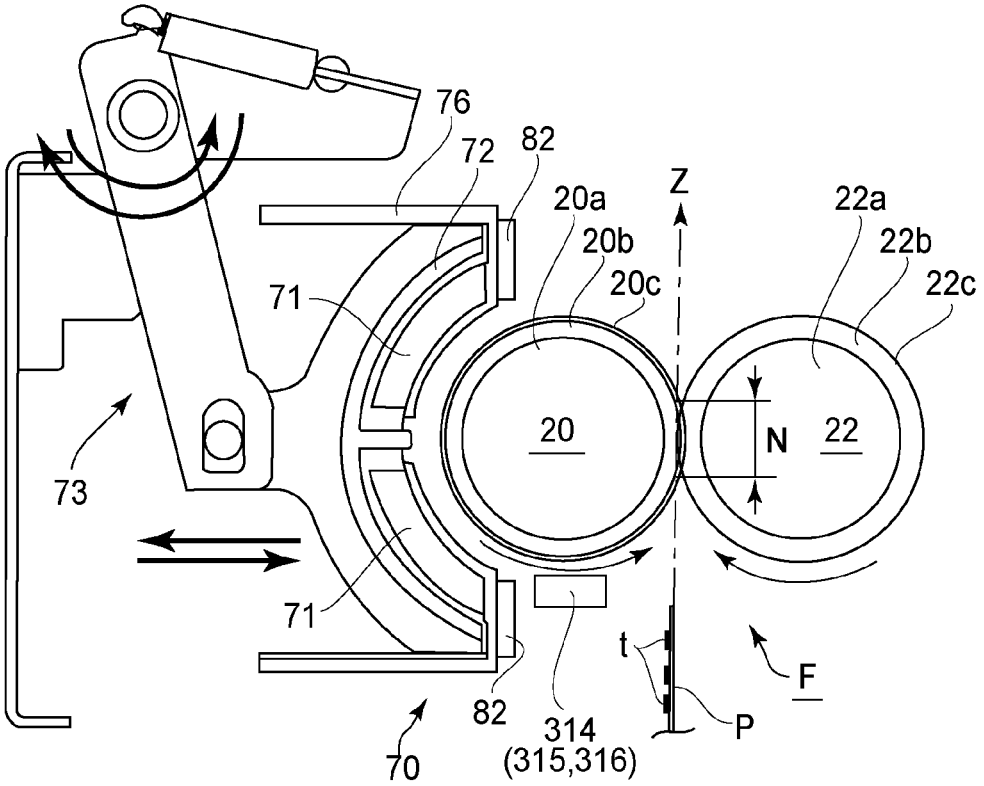
FIG. 3 is a schematic view of a cross section of a principal part of a fixing device in Embodiment 1.
Figure 4:
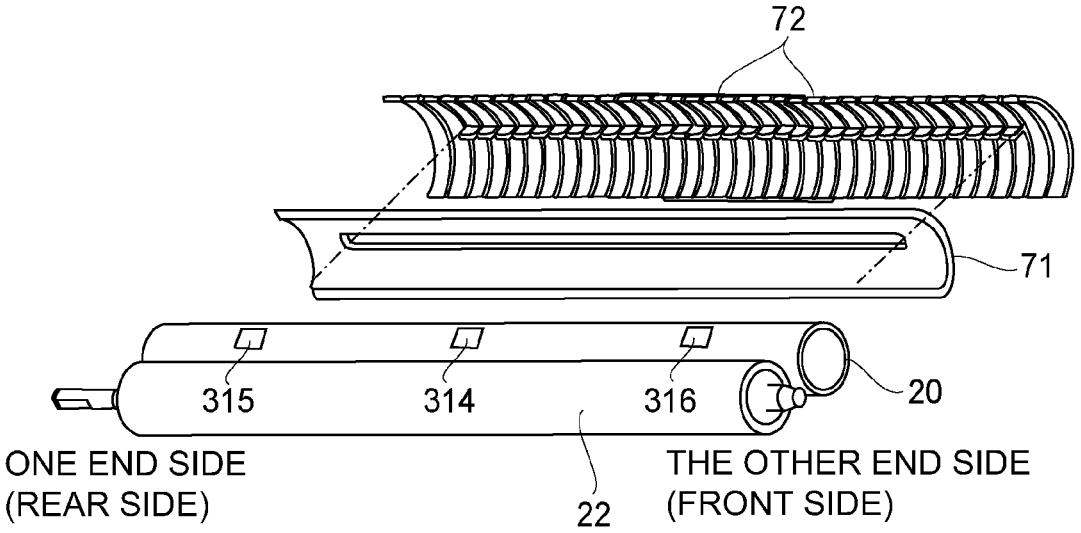
FIG. 4 is an exploded schematic perspective view of the principal part of the fixing device.
Figure 5:
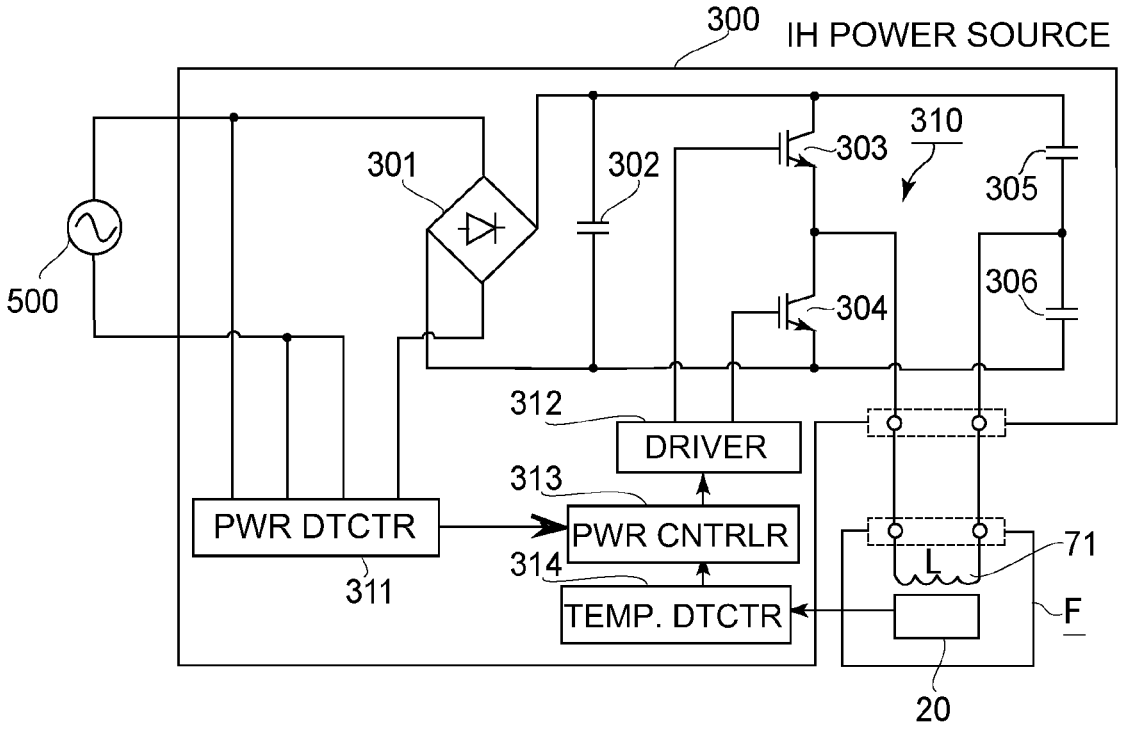
FIG. 5 is a circuit view of an induction heating device.

FIG. 3 is a schematic view of a cross section of a principal part of the fixing device F, FIG. 4 is a schematic perspective view of the principal part of the fixing device F, and FIG. 5 is a circuit diagram of an induction heating device. This fixing device F includes a pair of rotatable members for forming a nip (portion) N for fixing the toner image on the sheet P (on the recording material). Specifically, the fixing device F includes a fixing roller (rotatable heating member) 20 as a first rotatable member, and a pressing roller (rotatable pressing member) 22 as a second rotatable member. The fixing roller 20 is a fixing member for heating the sheet P in contact with a toner image carrying surface of the sheet P, and, to this fixing roller 20, the pressing roller 22, which is a pressing member, is press-contacted with respect to a horizontal direction, and forms the nip N for nipping and feeding the sheet P in cooperation with the fixing roller 20.

The fixing roller 20 is prepared by providing an elastic layer 20*b* of a silicone rubber on an outer peripheral surface of a metal core pipe 20*a* of a magnetic material, and then coating an outer peripheral surface of the elastic layer 20*b* with a parting layer 20*c* of a fluorine-containing resin material. The pressing roller 22 is disposed opposite to the fixing roller 20 and is urged toward the fixing roller 20 by unshown exciting coil springs disposed at shaft portions on both sides.

The pressing roller 22 is prepared by providing an elastic layer 22*b* of a silicone rubber on an outer peripheral surface of a metal core pipe 22*a* of a magnetic material, and then coating an outer peripheral surface of the elastic layer 22*b* with a parting layer 22*c* of a fluorine-containing resin material. The fixing roller 20 and the pressing roller 22 are connected by an unshown gear train provided at a longitudinal end portion, and are integrally rotated by being driven by a driving motor M1 (FIG. 1) connected with the gear train.

The fixing roller 20 is heated by an induction heating device 70 principally including an exciting coil 71 provided outside the fixing roller 20, a magnetic core 72, and a magnetic circuit member 82. The induction heating device 70 heats the fixing roller 20 by generating a magnetic flux. The fixing roller 20, as an induction heat generating member, uses a ferromagnetic metal (having a high magnetic permeability), such as iron, so that the magnetic flux generated from the induction heating device 70 is constrained in a greater amount inside the metal. By increasing magnetic flux density, eddy current is generated on the surface of the metal, so that the fixing roller 20 can be heated efficiently.

The exciting coil 71 and the magnetic core 72 are provided inside a housing 76 of the induction heating device 70. The exciting coil 71 is formed in an elongated circle shape with respect to a direction perpendicular to the drawing sheet. The magnetic core 72, which partly enters a central portion of the exciting coil 71, and which is divided into a plurality of magnetic cores with respect to the direction perpendicular to the drawing sheet of FIG. 3, are disposed. A magnetic core moving mechanism 73 is a mechanism for selectively moving the divided individual magnetic cores in a direction of approaching the fixing roller 20 and a direction of being spaced from the fixing roller 20. This mechanism 73 is outside of a gist of the present invention, and, therefore, will be omitted herein from detailed description.

The magnetic circuit member 82 forms a magnetic circuit of the magnetic flux generated by the exciting coil 71 so as to make a circuit around the magnetic core 72 and the metal core pipe 20*a* of the fixing roller 20. The magnetic core 72 and the magnetic circuit member 82 are used for enhancement in magnetic circuit efficiency and magnetic shielding of alternating current (AC) magnetic flux generated by the exciting coil 71. The magnetic core 72 uses, as a material, ferrite, or the like, having high permeability and low residual magnetic flux density in order to perform the function of efficiently guiding the AC magnetic flux to the induction heat generating member constituting the fixing roller 20.

As shown in FIG. 4, the exciting coil 71 has a substantially elliptical shape (elongated trough shape) with respect to a longitudinal direction, and is disposed along the outer peripheral surface of the fixing roller 20. The exciting coil 71 uses, as a core wire, the Litz wire which is a bundle of approximately eighty to one hundred sixty thin insulating coating electric wires each having a diameter of 0.1 mm to 0.3 mm. The core wire constitutes the exciting coil 71 by being wound eight times to twelve times around the magnetic core 72.

The magnetic core 72, divided into the plurality of magnetic cores, is disposed in an arranged state in a direction perpendicular to a sheet-feeding direction (recording material-feeding direction) Z. The magnetic core 72 is constituted so as to connect a winding central portion and an outer peripheral surface of the exciting coil 71 in an arcuate shape in cross section perpendicular to an axis of the fixing roller 20.

The fixing device F employs, in order to heat the fixing roller 20, an induction heating type device in which the eddy currents generated by the magnetic flux by the exciting coil 71 in the induction heat generating member provided in the fixing roller 20 to generate heat by Joule heat. In the induction heating type device, a heat generating position can be made very close to the nip N, and, therefore, compared with a heating roller type device, during power-on, a time required until a surface temperature of the fixing roller 20 reaches a temperature suitable for fixing may be short. Further, a heat transfer path from the heat generating position to the nip N is short and simple, and, therefore, thermal efficiency of the heating device is high.

When a high-frequency current is applied to the exciting coil 71, the fixing roller 20 generates heat. The exciting coil 71 generates the AC magnetic flux by the supplied AC current, and then, the AC magnetic flux is guided by the magnetic core to generate the eddy current in the fixing roller 20 as the induction heat generating member. The eddy current generates the Joule heat by a specific resistance of the induction heat generating member. That is, the fixing roller 20 is placed in an electromagnetic induction heat generating state by supplying the AC current to the exciting coil 71.

As shown in FIG. 5, an exciting circuit 310 supplies the high-frequency AC current to the exciting coil 71 of the fixing device F. The exciting coil 71 is connected between a connecting point of switching elements 303 and 304 and a connecting point of capacitors 305 and 306 in the exciting circuit 310 of an induction heating (IH) power source (supply) device 300 supplied with electrical power from a commercial AC voltage source 500. The exciting coil 71 generates the magnetic flux to induction-heat the fixing roller 20.

The IH power source device 300 constitutes a rectifying smoothing circuit by a diode bridge 301 and a filter capacitor 302 to generate a direct current (DC) voltage. An electrical power controller 313 alternately actuates the switching elements 303 and 304 via a driving portion 312, thus applying an AC voltage to the exciting coil 71. Each of the capacitors 305 and 306 is a resonance capacitor forming a resonance circuit together with the exciting coil 71. The driving portion 312 drives each of the two switching elements 303 and 304. A power detecting portion 311 detects input electrical power of the IH power source device 300.

As described above, the fixing roller 20 and the pressing roller 22 are rotationally driven, and the fixing roller 20 is heated by the induction heating device 70. Then, as described below, the fixing roller 20 is temperature-controlled to a predetermined temperature, and the sheet P carrying the unfixed toner image t is introduced into the nip N. The sheet P is heated by the fixing roller 20 by being nipped and fed in the nip N and is subjected to a nip pressure, so that the unfixed toner image t is thermocompression-fixed (heat-fixed) to the sheet P. The sheet P, having passed through the nip N, is separated from the fixing roller 20 and is discharged and fed from the fixing device F.

As shown in FIG. 4, temperature detecting elements 314, 315, and 316 are provided at positions opposing the fixing roller 20, and detect temperatures of the fixing roller 20 at positions of a longitudinally central portion, one end side (hereafter referred to as a rear-side) and the other end side (hereafter referred to as a front-side). The temperature detecting elements 314, 315, and 316 are temperature sensors, such as thermistors, or the like. That is, the plurality of temperature detecting elements 314, 315, and 316 for detecting the temperatures of the fixing roller 20 at a plurality of positions spaced from each other with respect to a widthwise direction of the fixing roller 20.

The central temperature detecting element 314 detects the temperature of the fixing roller 20 at the longitudinally central portion, and the power controller 313 is controlled, so that the temperature of the fixing roller 20 is caused to rise to a predetermined temperature and becomes constant. Incidentally, not only an example in which the central temperature detecting element 314 is disposed at a completely central position with respect to the longitudinal direction of the fixing roller 20, but also an example in which the central temperature detecting element 314 is disposed so as to be somewhat deviated from the central position may be employed. That is, the central temperature detecting element 314 may only be required to provide a positional relationship such that the central temperature detecting element 314 overlaps with a minimum size recording material capable of being introduced into the fixing device F. Thus, in this embodiment, in either example, the central temperature detecting element 314 will be described as the central temperature detecting element that detects the temperature of the fixing roller 20 with respect to the longitudinally central portion. The rear-side temperature detecting element 315 and the front-side temperature detecting element 316 are disposed at positions opposing both end portions of the fixing roller 20 and detect the temperatures of the fixing roller 20 at the longitudinal end portions of the fixing roller 20. Incidentally, the rear-side temperature detecting element 315 and the front-side temperature detecting element 316 may be used in not only an examples in which these temperature detecting elements are disposed at positions that are extreme longitudinal end portions, but also an example in which these temperature detecting elements 315 and 316 are disposed so as to be somewhat deviated from the extreme longitudinal end portions, respectively, toward an inside. Thus, in this embodiment, in either example, the rear-side temperature detecting element 315 will be described as the rear-side temperature detecting element that detects the temperature of the fixing roller 20 at the longitudinal end portion. This is also similarly true for the front-side temperature detecting element 316.

In this embodiment, the rear-side temperature detecting element 315 and the front-side temperature detecting element 316 are equidistantly spaced from the central temperature detecting element 314 and are disposed at positions of 115 mm from the longitudinally central position of the fixing roller 20. That is, the rear-side temperature detecting element 315 and the front-side temperature detecting element 316 are disposed inside a sheet pressuring width of an envelope of a square 2 size (240 mm width).

The power controller 313 determines a condition of electrical power to be output by the driving portion 312 from an operation instruction from the controller 100 of the image forming apparatus 30 and a state of the fixing device F, such as a temperature detection result of the temperature detecting portion 314. The driving portion 312 drives the two switching elements 303 and 304 in accordance with the power condition determined by the power controller 313.

Embodiment 1

In this embodiment, even in the case in which an envelope with different laminating (bonding) positions of the envelope is used, an optimum control temperature is determined by the temperatures of the respective temperature detecting elements 314, 315, and 316. By this arrangement, a fixing device constituted so that an image quality is not impaired due to improper fixing and excessively high glossiness is realized.

Figure 1:
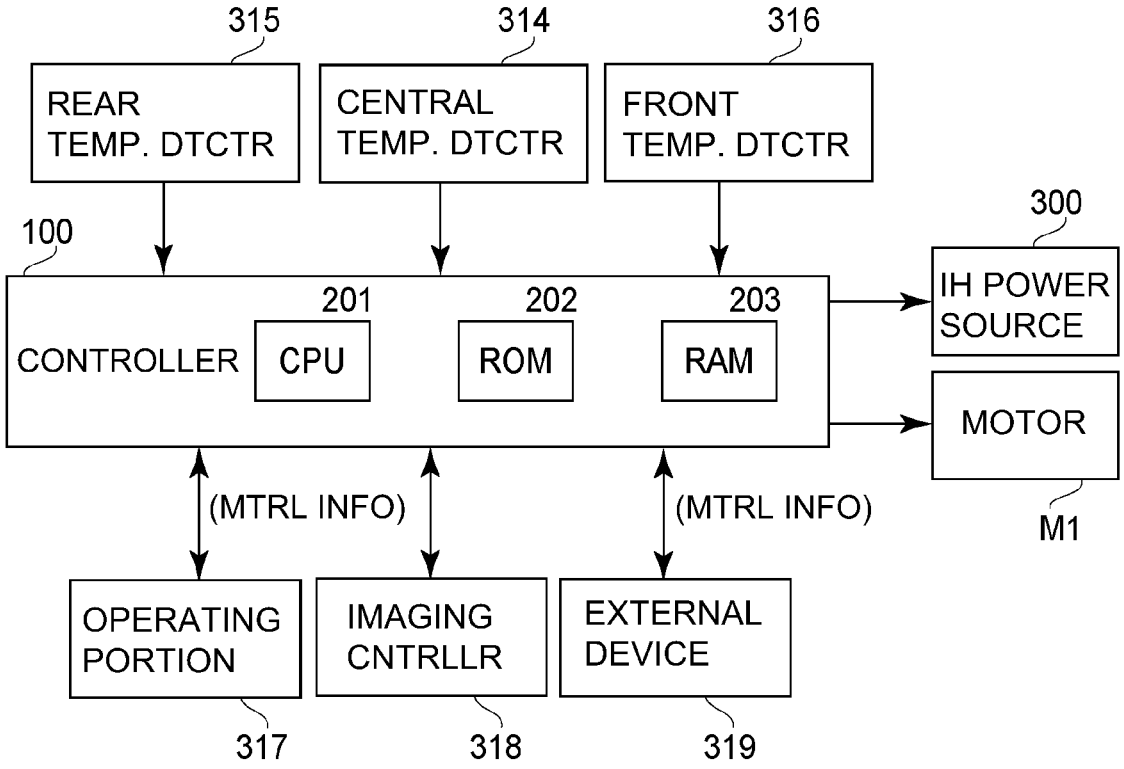
FIG. 1 is a block diagram of a control system of an apparatus in Embodiment 1.

FIG. 1 is a control block diagram of an apparatus in Embodiment 1. The controller 100 includes a central processing unit (CPU) 201, a read only memory (ROM) 202, and a random access memory (RAM) 203. The controller 100 controls the IH power source device 300 on the basis of detection temperatures of the central temperature detecting element 314, the rear-side temperature detecting element 315 and the front-side temperature detecting element 316 so that the surface temperature of the fixing roller 20 is constant at a predetermined temperature.

Information (size, basis weight, kind, or the like) on a sheet kind (recording material kind) using (subjected to a heating process), as an inputting portion, the external device 319, such as the operating portion 317, a personal computer (PC), or the like, is capable of being set in the controller 100. Further, the controller 100 controls an image formation controller 318 and the driving motor (apparatus driving source) M1.

Figure 6:
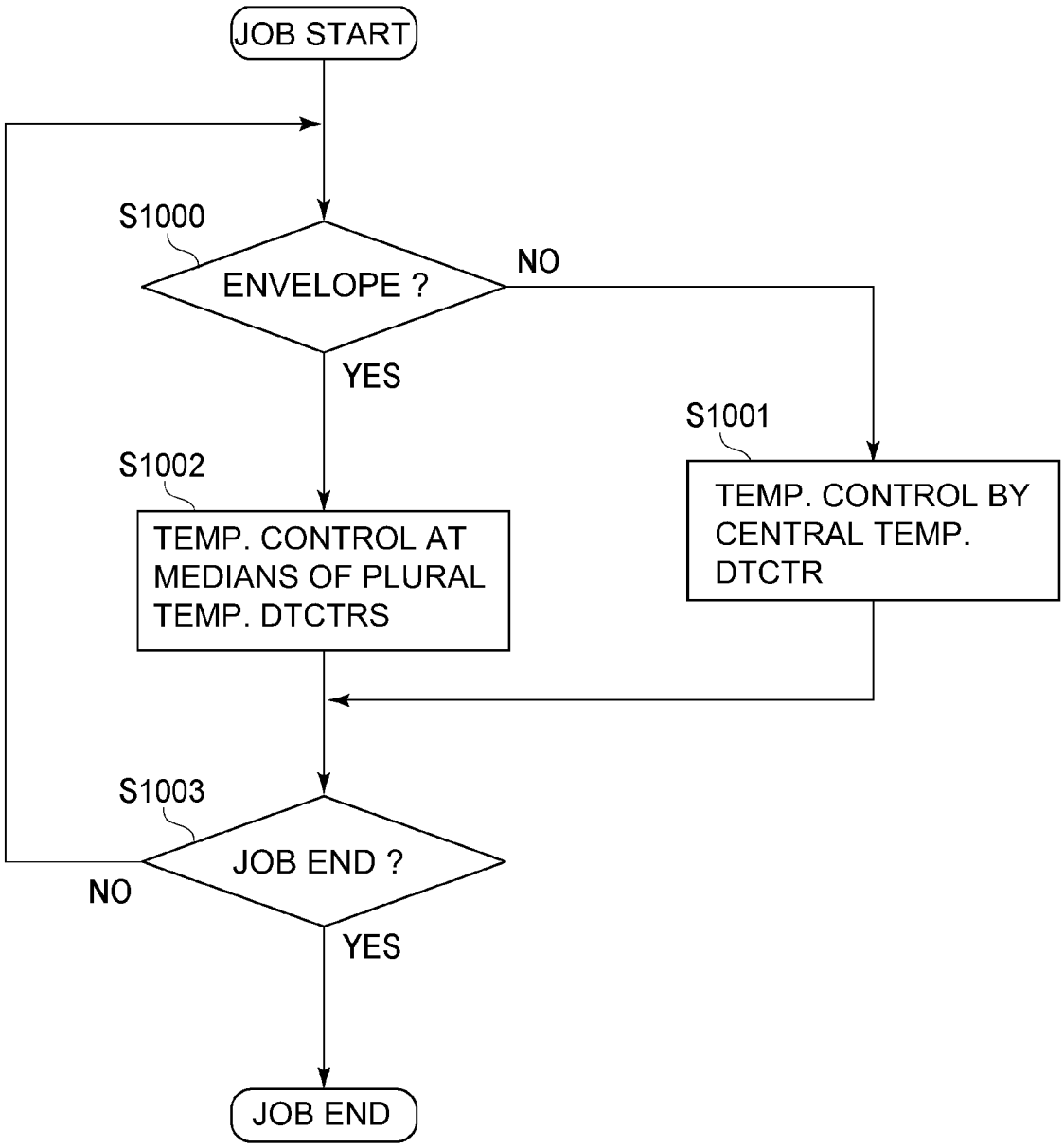
FIG. 6 is a flowchart of control in Embodiment 1.

FIG. 6 is a flowchart of actuation control of the fixing device F of Embodiment 1. After a print job is started, the controller 100 checks whether or not an envelope (envelope job) is designated, as a sheet to be used in the apparatus, from the external device 319, such as the operating portion 317 or the PC, as the inputting portion of the sheet information (recording material information) on the sheet to be used (S1000). That is, the controller 100 discriminates, on the basis of the sheet information that is acquired from the operating portion 317 or the external device 319 and that is to be used, whether or not the sheet is constituted, so that a plurality of sheet parts are superposed.

In the case in which the job is not the print job using the envelope (in the case in which the job is a print job using a sheet other than the envelope), the temperature of the longitudinally central portion of the fixing roller 20 is detected by the central temperature detecting element 314. On the basis of detection temperature information thereof, the power controller 313 is controlled so that the temperature of the fixing roller 20 is constant at the predetermined temperature (S1001). In this embodiment, the power controller 313 is controlled so that the central temperature detecting element 314 is capable of maintaining a temperature of 180° C.

In the case of the print job (envelope job) using the envelope, the power controller 313 is controlled so that the detection temperature, which is a median value of the temperature detecting element of the central, front-side, and rear-side temperature detecting elements 314, 315, and 316, is maintained at a certain temperature (S1002). In this embodiment, the power controller 313 is controlled so that the temperature detecting element providing the median value is 190° C. in temperature. In the case in which the sheet passing is ended, the job is ended, and, in the case in which a job is subsequently carried out, the sequence is returned to S1000 again, so that the controller 100 discriminates whether or not the job is the envelope job (S1003).

In this embodiment, as the temperature detecting element controlled at a certain temperature in S1002, the controller (selecting portion) 100 selected the temperature detecting element providing the median value. Here, the median value is a value positioned at a center when the detection temperatures are sorted in ascending order. Accordingly, the temperature detecting element providing the median value is the temperature detecting element indicating a temperature of the median value when the detection temperatures are sorted in the ascending order. In the case in which a variation of each of the temperature detecting elements 314, 315, and 316 is known from data during idling or during shipping, the temperature detecting element providing the median value determined from values offset by variations may also be selected. Here, during idling is during a rotational state of the fixing roller 20 and the pressing roller that are in a state that the sheet P does not pass through the nip N.

An operation in this embodiment will be described. In an environment of 15° C., 500 sheets of envelope 1 (center bonding) of a square 2 size with a basis weight of 100 g/m$^2$ were passed through the nip N with productivity of ten sheets per minute.

Envelope 1: square 2, center bonding, craft CoC 100, no postal code frame, manufactured by Kabushiki Kaisha Yamazakura.

A schematic view of a detection temperature change of the respective temperature detecting elements 314, 315, and 316 at this time is shown in part (b) of FIG. 7, and a schematic view of a longitudinal temperature distribution of the fixing roller 20 and a relationship of the respective temperature detecting elements 314, 315, and 316 and a laminating position of the envelope is shown in part (a) of FIG. 7.

From part (b) of FIG. 7, it is understood that a lowering in temperature becomes large at the laminating position portion of the envelope. This is because three sheets, each with a basis weight of 100 g/m$^2$ are superposed at the laminating position portion, whereas only two sheets are superposed at a portion other than the laminating position, and, therefore, a heat quantity taken from the surface of the fixing roller 20 is different, and, therefore, such a temperature difference occurs.

From the longitudinal temperature distribution of the fixing roller 20 at this time, it is understood that the temperature lowers at a portion of the central temperature detecting element 314. In this embodiment, the central temperature detecting element 314 is 180° C., and both the front-side and rear-side temperature detecting elements 316 and 315 are 190° C., and, therefore, temperature control is carried out by the front-side or rear-side temperature detecting element 316 or 315 providing the median value of the plurality of detection temperatures of the temperature detecting elements 314, 315, and 316. As a result, in an entirety of a sheet passing region of the envelope, a good fixing performance was obtained without falling below a fixable temperature of 175° C. in the constitution of this embodiment.

Next, five hundred sheets of envelope 2 (end bonding) of a square 2 size in which the laminating position of the envelope is not the center bonding (position) but is an end bonding (position) were similarly passed through the nip N with productivity of ten sheets per minute.

Envelope 2: square 2, end bonding, craft CoC 100, no postal code frame, manufactured by Kabushiki Kaisha Yamazakura A schematic view of a detection temperature change of the respective temperature detecting elements 314, 315, and 316 is shown in part (b) of FIG. 8, and a schematic view of a longitudinal temperature distribution of the fixing roller 20 and a relationship of the respective temperature detecting elements 314, 315, and 316 and laminating position of the envelope is shown in part (a) of FIG. 8.

From parts (a) and (b) of FIG. 8, it is understood that a lowering in temperature becomes large at a portion of the rear-side temperature detecting element 315 being in the laminating position of the envelope. In this embodiment, the rear-side temperature detecting element 315 is 180° C., and both the front-side and central temperature detecting elements 316 and 314 are 190° C. Therefore, temperature control is carried out so that the front-side or central temperature detecting element 316 or 314 providing the median value of the plurality of detection temperatures of the temperature detecting elements 314, 315, and 316 is 190° C.

Also in the case where the envelope laminating position is the end bonding (position), similarly as the center bonding (position), in an entirety of a sheet passing region of the envelope, a good fixing performance was obtained without falling below a fixable temperature of 175° C. in the constitution of this embodiment.

Next, as Comparison Example 1, similar sheet passing was carried out by controlling the central temperature detecting element 314 always at a constant temperature of 180° C., as conventionally done. In the case in which the envelope laminating position is the center bonding (position), a temperature distribution and a temperature change were the same as the temperature distribution and the temperature change of parts (a) and (b) of FIG. 7, so that a good fixing performance was obtained. In the case in which the envelope laminating position is the end bonding (position), the temperature distribution and the temperature change were as shown in parts (a) and (b) of FIG. 9, so that, due to a temperature lowering at the envelope laminating position, the temperature is below the fixable temperature of 175° C., and improper fixing occurred.

In order that the temperature is not below the fixable temperature, as Comparison Example 2, similar sheet passing was carried out by controlling the central temperature detecting element 314 at a constant temperature of 190° C., in the end bonding, a temperature distribution and a temperature change were the same as the temperature distribution and the temperature change of parts (a) and (b) of FIG. 8, so that a good fixing performance was obtained. On the other hand, in the case of the center, the temperature at portions other than the laminating position was 200° C., so that glossiness was excessively high and thus, a high quality image was not obtained.

In the case in which the sheet is constituted by superposing the plurality of sheet parts, i.e., in the case in which the recording material is discriminated as being the envelope, the controller 100 carries out the control in the following, as described above, on the basis of the sheet information acquired from an inputting portion 317 or 319. That is, as regards the plurality of temperature detecting elements 314, 315, and 316, the controller 100 carries out the temperature control of the fixing roller 20 on the basis of a plurality of pieces of the temperature information of the plurality of temperature detecting elements corresponding to a passing width of the sheet.

As described above, in the constitution of this embodiment, even in the case in which the envelopes different in envelope laminating position from each other are used, the controller 100 effects the control by selecting the temperature detecting element providing the median value of the detection temperatures of the respective temperature detecting elements 314, 315, and 316. By this arrangement, it is possible to realize a fixing device by which the image quality is not impaired due to the improper fixing and the excessively high glossiness.

When the control is carried out using the median value, the influence by a variation due to a deviation of a longitudinal position of the sheet becomes small. For example, in the case in which a distance of the temperature detecting element 315 from the envelope end portion is small (close), the temperature becomes high by heat transfer from a non-sheet-passing-portion region. When the temperature control is carried out at this portion, in the case where the laminating position is in a central position, the temperature of the central temperature detecting element 314 becomes low in some instances.

Embodiment 2

In Embodiment 2, in the case in which three or more temperature detecting elements are provided at positions corresponding to a sheet passing position in the fixing device F of Embodiment 1, control similar to the control in Embodiment 1 is carried out, and Embodiment 2 is different from Embodiment 1 in that, in the case in which two or less temperature detecting elements are provided at a position corresponding to the sheet passing position, the control is carried out using only the central temperature detecting element 314.

The control in this Embodiment 2 is the same as the control in Embodiment 1 in device structure and control of the image formation, or the like, except that the flowchart of FIG. 6 is replaced with a flowchart of FIG. 10 and that a longitudinal arrangement of the rear-side temperature detecting element 315 and the front-side temperature detecting element 316 relative to the fixing roller 20 is different from that in Embodiment 1.

In Embodiment 1, each of the rear-side temperature detecting element 315 and the front-side temperature detecting element 316 was equidistantly spaced from the central temperature detecting element 314 at a position of 115 mm from the longitudinally central position of the fixing roller 20. On the other hand, in this Embodiment 2, each of the temperature detecting elements 316 and 315 was disposed at a position of 50 mm from the longitudinally central position of the fixing roller 20.

In the following description, the flowchart of FIG. 10 will be described, but portions performing operations similar to those in Embodiment 1 are represented by using the same reference numerals or symbols and will be omitted from description. In this Embodiment 2, in the case in which the job is discriminated as the envelope job in S1000, it is determined whether or not there are three or more temperature detecting elements in a sheet passing width range of the envelope (S2000). In the case in which the three or more temperature detecting elements exist in the sheet passing width (range), temperature control is carried out using the median value of the detection temperatures of the plurality of temperature detecting elements similarly as in S1002.

In the case in which two or less temperature detecting elements are in the sheet passing width range of the envelope, a feeding interval of the envelope is increased so that the temperature does not excessively lower (sheet passing interval UP mode), and the control is carried out using the central temperature detecting element 314 (S2001, S1001). In S2001, the control is carried out so that the number of sheets outputted per one minute is 50% of that in the normal operation.

The control described above is summarized as follows. In the case in which the sheet to be used is discriminated as being constituted by superposing the plurality of sheet parts, the controller 100 carries out the following control on the basis of the sheet information acquired from an inputting portion 317 or 319. That is, as regards the plurality of temperature detecting elements 314, 315, and 316, the controller 100 carries out the temperature control of the fixing roller 20 on the basis of the temperature information of one temperature detecting element, determined in advance, of the plurality of temperature detecting elements corresponding to a passing width of the sheet.

In order to check the operation, similarly as in Embodiment 1, sheet passing of five hundred sheets of each of envelope 3 (long 3 size, center bonding), envelope 4 (long 3 size, end bonding), envelope 5 (long 4 size, center bonding), and envelope 6 (long 4 size, end bonding) with fourteen sheets per one minute was carried out.

Envelope 3: long 3, center bonding, hon kent CoC 100, no postal code frame

Envelope 4: long 3, end bonding, hon kent CoC 100, no postal code frame

Envelope 5: long 4, center bonding, hon kent CoC 80, no postal code frame

Envelope 6: long 4, end bonding, BS kent CoC 80, no postal code frame

FIG. 11 shows a relationship of a longitudinal arrangement of the temperature detecting elements with respective envelopes in this Embodiment 2. In the case in which the envelope 3 and the envelope 4 are passed through the nip N, those envelopes have a long 3 size (120 mm width), and, therefore, the rear-side and front-side temperature detecting elements 315 and 316 fall within the envelope sheet passing width (range), and, therefore, an operation similar to the operation in Embodiment 1, so that a good fixing property is obtained.

In the case in which the envelope 5 and the envelope 6 are passed through the nip N, these envelopes have a long 4 size (90 mm width), and, therefore, the rear-side and front-side temperature detecting elements 315 and 316 being in positions of 50 mm from the center fall within the envelope regions. As a result, by the control of S2001, the sheets were output in the sheet passing interval UP mode in which the number of sheets outputted per (one) minute was lowered from fourteen sheets to seven sheets.

In the case of the envelope 5, the envelope with the envelope laminating position, which is the center position, is controlled by the central temperature detecting element 314, and, therefore, a problem such that improper fixing and excessively high glossiness occur similarly as in Embodiment 1, did not arise.

In the case here, the envelope laminating position is the end bonding (envelope 6), the temperature distribution and the temperature change as shown in parts (a) and (b) of FIG. 12 were obtained. In parts (a) and (b) of FIG. 12, A shows a position of the front-side portion of the envelope. The control is carried out by the central temperature detecting element 314, and, therefore, the center temperature is maintained at 180° C., but the temperature at a position of an envelope laminating position portion B lowers.

The sheet interval increases, however, as in the control of S2001, and, therefore, although the temperature lowers at the laminating position portion, heat transfer in the longitudinal direction of the roller occurs during idling of the fixing roller 20 and the pressing roller 22. By this arrangement, the improper fixing due to the temperature falling below the fixable temperature of 175° C. did not occur.

As described above, in the constitution of this Embodiment 2, the control is carried out similarly as in Embodiment 1 only in the case in which three or more temperature detecting elements are in positions corresponding to the positions in which the sheets pass. Further, in the case in which only two or less temperature detecting element is in a position corresponding to the position in which the sheets pass, by increasing the sheet interval, a constitution can be employed so as not to cause the improper fixing and the excessively high glossiness.

Embodiment 3

Embodiment 3 is different from Embodiment 2 in that, in the case in which two temperature detecting elements are provided at positions corresponding to a sheet passing position in Embodiment 2, control is carried out using the central temperature detecting element with a higher detection temperature. The control in Embodiment 3 is the same as the control in Embodiment 2 in device structure and control of the image formation, or the like, except that the flowchart of FIG. 10 is replaced with a flowchart of FIG. 13, and that a longitudinal arrangement of the rear-side temperature detecting element 315 relative to the fixing roller is different from that in Embodiment 2.

In this embodiment, the rear-side temperature detecting element 315 is provided in a position of 40 mm from a longitudinally central position, and the front-side temperature detecting element 316 is provided in a position of 50 mm from the longitudinally central position. In the following description, the flowchart of FIG. 13 will be described, but portions performing operations similar to those in Embodiments 1 and 2 are represented by adding the same reference numerals or symbols, and will be omitted from description.

In this Embodiment 3, when two or less temperature detecting elements are in a sheet passing width range of the envelope in S2001, it is determined whether or not there are two temperature detecting elements in the sheet passing width range (S3000). In the case in which a single temperature detecting element is in the sheet passing width range, a sheet interval is increased so that the temperature of the temperature detecting element does not excessively lower, and the control is carried out using the central temperature detecting element 314 (S2001, S1001). In the case in which the two temperature detecting elements are in the sheet passing width range, the temperature control is carried out using the temperature detecting element with the higher detection temperature so that the fixing (device) surface temperature is 190° C. (S3001).

In the case in which the envelope 6 is passed through the nip N, similarly as in Embodiment 2, a temperature distribution and a temperature change, as shown in parts (a) and (b) of FIG. 14, were obtained. In part (a) of FIG. 14, A shows a position of the front-side portion of the envelope. The temperature lowers at a portion of the rear-side temperature detecting element 315, but the central temperature detecting element 314 with the higher detection temperature is controlled at 190° C., and, therefore, the improper fixing due to the temperature falling below the fixable temperature of 175° C. does not occur.

In the case in which the two temperature detecting elements are in the sheet passing width range, as in Embodiment 3, the temperature control is carried out using the temperature detecting element with the higher detection temperature, so that a constitution can be employed so as not to cause the improper fixing and the excessively high glossiness without lowering the number of sheets outputted per (one) minute, as in Embodiment 2.

The above-described control is summarized as follows. In the case in which the sheet to be used is discriminated as being constituted by superposing the plurality of sheet parts, the controller 100 carries out the following control on the basis of the sheet information acquired from an inputting portion 317 or 319.

As regards the plurality of temperature detecting elements 314 to 316, in the case in which temperature detecting element(s) of a certain number or more does (do) not exist in a passing width of the sheet, on the basis of temperature information of the temperature detecting element(s) corresponding to the sheet passing region width, whether or not the temperature control of the fixing roller 20 is carried out using which temperature detecting element(s) is determined. That is, on the basis of the temperature information of the temperature sensor(s), of the plurality of temperature sensors, corresponding to the recording material passing region width, whether or not the temperature control of the fixing roller 20 is carried out by which temperature sensor(s) in the recording material passing region width is determined.

Embodiment 4

Embodiment 4 is applied to the fixing device of Embodiment 1, in which a pressure (pressing force) is made variable in order to meet an envelope crease. Control, such as image formation, or the like, in this embodiment are the same as those in Embodiment 1, except that a pressure changing mechanism is added to a device constitution in Embodiment 4. In the following description, the pressure changing mechanism and an effect thereof will be described, but portions performing operations similar to those of the fixing device in Embodiment 1 are represented by adding the same reference numerals or symbols and will be omitted from description.

Here, in the following description, with respect to a fixing device F, a front surface (side) is a surface (side) where the fixing device F is viewed from a sheet entrance side, and left and right are left and right when the device is viewed from a principal surface (side). An upstream side and a downstream side are the upstream side and the downstream side with respect to the sheet-feeding direction Z.

FIG. 15 is a perspective view of the fixing device F of Embodiment 4. Part (a) of FIG. 16 is a schematic view of a cross-sectional left-side surface of a principal part of the fixing device, part (b) of FIG. 16 is a partially enlarged view of part (a) of FIG. 16, and part (c) of FIG. 16 is a cross-sectional view of a pressure applying member (pressing pad). Parts (a) and (b) of FIG. 17 are a left-side surface view of the fixing device F and a left-side surface view of the fixing device F that is partly cut away, respectively.

A heating assembly 501 includes a cylindrical flexible fixing belt (endless belt) 506. The belt 506 includes a magnetic member (metal layer, or electroconductive member) generating heat through electromagnetic induction when the belt 506 passes through a region where a magnetic field (magnetic flux) generating from the exciting coil 71 exists. Further, the heating assembly 501 includes a stay 507 made of metal inserted into the belt 506. At a lower surface of the stay 507, a pressing pad (nip pad) 508 as a pressure applying member is mounted along a longitudinal direction.

The pad 508 is a member for forming a nip (fixing portion, or fixing nip (portion)) N between the belt 506 and the pressing roller 22 by causing a pressure therebetween, and is made of a heat-resistant resin material. An opposing portion of the pad 508 to an inner surface of the belt 506 is constituted by an upstream-side projection 508*a*, a main pressing portion 508*b* and a downstream-side projection 508*c*, as shown in parts (a) and (b) of FIG. 16.

That is, the pad 508 has a constitution such that a projected portion, which is the upstream-side projection 508*a*, is provided at a portion upstream of the nip N and a projected portion, which is the downstream-side projection 508*c*, is provided at a portion downstream of the nip N, and that the main pressing portion 508*b* is provided between the projected portions 508*a* and 508*c*. The main pressing portion 508*b* is not necessarily required to be flat, and may only be required that the main pressing portion 508*b* is remoter from the inner surface of the belt 506 than is a portion connecting a free end of the upstream-side projection 508*a* and a free end of the downstream-side projection 508*c* by a flat plane.

More specifically, the pad 508 is a pressure applying member constituted so that the nip N is formed by applying a pressure toward the pressing roller 22 relative to the belt 506 while sandwiching the belt 506 between itself and the pressing roller 22. Further, the pad 508 includes, in a cross-sectional surface, the main pressing portion 508*b* in the neighborhood of a center of the nip N at an opposing portion to the inner surface of the belt 506. Further, the projected portions 508*a* and 508*c* projecting from the main pressing portion 508*b* toward the belt 506 are provided on sides upstream and downstream of the main pressing portion 508*b*, respectively, with respect to the sheet-feeding direction Z.

Further, the pad 508 is provided with a crown for correcting flexure when a pressure is applied thereto, and a crown amount used in this embodiment is 1.6 mm between a longitudinal central portion and a longitudinal end portion (position of 200 mm from the longitudinal center) of the pad 508.

The stay 507 requires rigidity for applying the pressure to the nip N, and, therefore, is made of metal in this embodiment. Further, on an upper surface side (on the exciting coil 71 side) of the stay 507, a magnetic (material) core (inside magnetic core) 509 for concentrating an induction magnetic field at the belt 506 in order to efficiently heat the belt 506 is provided over a longitudinal direction of the stay 507.

Left and right (both) end portions of the stay 507 project outwardly from left and right (both) end portions the belt 506, respectively. On both end portions, flange members (fixing flanges) 510L and 510R having a bilaterally symmetrical shape are engaged. The flange members 510L and 510R are regulating members (preventing members) for regulating (preventing) movement of the belt 506 in the longitudinal direction (widthwise direction, or left-right direction) and a shape of the belt 506 with respect to a circumferential direction. The belt 506 is externally fitted loosely to an assembly of the stay 507, the pad 508, and the core 509 described above. The movement of the belt 506 in the longitudinal direction is regulated (prevented) by inward surfaces of the flange members 510L and 510R.

The belt 506 includes, as described later, a base layer 506*a* (FIG. 18) constituted by metal generating heat through electromagnetic induction heating. For that reason, as a means for regulating (preventing) a shift of the belt 506 in a rotating state in the longitudinal direction, it is sufficient that the flange members 510L and 510R including flange portions for only receiving simply the end portions of the belt 506 are provided. By this arrangement, there is an advantage that the structure of the fixing device F can be simplified.

At a longitudinal central portion of the pad 508, a temperature sensor, such as a thermistor, or the like, as the central temperature detecting element 314 for detecting the temperature of the belt 506, is provided through a supporting member 511 having elasticity. The temperature detecting element elastically contacts the member 511 toward the inner surface of the belt 506. By this arrangement, even when a positional fluctuation, such as waving of a temperature detecting element contact surface of the belt 506 to be rotated, occurs, the central temperature detecting element 314 follows this fluctuation, so that a good contact state with the inner surface of the belt 506 is maintained.

The heating assembly 501 is disposed so that the flange members 510L and 510R are engaged with guide slit portions 505*a* provided in side plates 505L and 505R of a device casing 505, respectively, with respect to a vertical direction. Accordingly, the heating assembly 501 has a latitude such that the heating assembly 501 is movable in an up-down direction along the slit portions 505*a* between the side plates 505L and 505R as a whole.

FIG. 18 is a schematic view showing a layer structure of the belt 506. In this embodiment, the belt 506 is 30 mm in an inner diameter and includes a nickel base layer (magnetic member or, metal layer) 506*a* manufactured by electrocasting. A thickness of this base layer 506*a* is 40 μm. At an outer periphery of the base layer 506*a*, as an elastic layer 506*b*, a heat-resistant silicone rubber layer is provided. A thickness of the layer 506*b* may preferably be set in a range of 100 μm to 1000 μm.

In this embodiment, in consideration that a warming-up time is shortened by decreasing a thermal capacity of the belt 506 and that a suitable fixed image is obtained when a color image is fixed, the thickness of the layer 506*b* is 300 μm. The silicone rubber has JIS-A hardness of 20 degrees and is 0.8 W/mK in thermal conductivity. Further, at a periphery of the layer 506*b*, as a surface parting layer 506*c*, a fluorine-containing resin layer (for example, perfluoroalkoxy alkane (PFA) or polytetrafluoroethylene (PTFE)) is formed in a thickness of 30 μm.

On an inner surface side, in order to lower sliding friction between the belt inner surface and the central temperature detecting element 314, a resin layer (lubricating layer) 506*d* of the fluorine-containing resin or polyimide may also be provided in a thickness of 10 μm to 50 μm. In this embodiment, as the layer 506*d*, the layer of polyimide was provided in a thickness of 20 μm.

The belt 506 has low thermal capacity and flexibility (elasticity) as a whole and maintains a cylindrical shape in a free state. As a material of the metal layer 506*a*, in addition to nickel, it is possible to select a metal alloy and metal, such as copper or silver. Further, a constitution in which the resin base layer is laminated with these metals may be employed. A thickness of the metal layer 506*a* may be adjusted depending on a frequency of a high-frequency current caused to flow through the exciting coil 71, described later, and permeability and electrical conductivity of the metal layer 506*a*, and may preferably be set between about 5 μm to 200 μm.

The pressing roller 22 is disposed by being rotatably supported at both end portions of the metal core 22*a* by the side plates 505L and 505R of the device casing 505 via bearings 512, and is rotationally driven by the driving motor M1.

Pressing Mechanism 504 and Changing Mechanism

A pressing mechanism 504 is, in this embodiment, a pressing means for forming a predetermined nip between the belt 506 and the pressing roller 22 by pressing the pad 508 of the heating assembly toward the pressing roller 22 via the belt 506 with a predetermined pressing force (pressure). In this embodiment, the pressure (pressed state) of this pressing mechanism 504 is constituted so as to be changeable by a changing mechanism.

Further, the controller 100 controls the changing mechanism on the basis of sheet information acquired from the inputting portion 317 or 319, and thus, executes switching of the pressed state of the pressing mechanism 504 between a first pressing mode and a second pressing mode in which the pressing force is decreased so as to be less than in the first pressing mode.

In the following description, a specific mechanism constitution will be described. At outside upper portions of the side plates 505L and 505R, a pair of left and right elongated pressing levers 518L and 519R extending in a front-rear direction (sheet-feeding direction) are provided, respectively, as pressing members in a bilaterally symmetrical state.

The lever 518L is positioned on an upper side of a portion-to-be-pressed 510*a* of the flange member 510L, and a rear end portion thereof is pivoted rotatably about a supporting shaft 518*a* in an up-down direction relative to the side plate 505L at a position behind the flange member 510L. That is, the lever 518L is operable in a direction in which the lever 518L press-contacts the portion-to-be-pressed 510*a* of the flange member 510L with the supporting shaft 518*a* as a fulcrum or in a direction of being spaced from the portion-to-be-pressed 510*a*.

A front end portion of the lever 518L is positioned on a front-side than the flange member 510L. The lever 518L is always rotated and urged downwardly about the shaft 518*a* by a spring force of a spring 519*a* of a spring screw 519L as an urging member provided between itself and the side plate 505L.

The lever 518R is positioned on an upper side of a portion-to-be-pressed 510*a* of the flange member 510R, and a rear end portion thereof is pivoted rotatably about a supporting shaft 518*a* in an up-down direction relative to the side plate 505R at a position behind the flange member 510R. That is, the lever 518R is operable in a direction in which the lever 518R press-contacts the portion-to-be-pressed 510*a* of the flange member 510R with the supporting shaft 518*a* as a fulcrum or in a direction of being spaced from the portion-to-be-pressed 510*a*.

A front end portion of the lever 518R is positioned more so on a front-side than the flange member 510R. The lever 518L is always rotated and urged downwardly about the shaft 518*a* by a spring force of a spring 519*a* of a spring screw 519R as an urging member provided between itself and the side plate 505R.

Further, during a free state of the levers 518L and 518R, lower surfaces of the respective levers 518L and 518R are sufficiently pressed against upper surfaces of the portions-to-be-pressed 510*a* of the flange members 510L and 510R, respectively, by the spring forces defined by the springs 519*a* of the spring screws. In this embodiment, this pressure is set at 550N, for example. By this arrangement, in the heating assembly 501, the stay 507 and the pad 508 are pressed down together with the flange members 510L and 510R, so that the pad 508 is press-contacted to the pressing roller 22 against elasticity of the elastic layer while sandwiching the belt 506 between itself and the pressing roller 22.

By this press-contact arrangement, the nip N with a predetermined width with respect to the sheet-feeding direction Z is formed between the belt 506 and the pressing roller 22. The pad 508 assists formation of a pressure profile of the nip N. A constitution at this time is called a pressure constitution.

Between the side plates 505L and 505R, a cam shaft 521 is rotatably provided via bearings (not shown). At both end portions of the cam shaft 521, eccentric cams (pressure releasing members) 522L and 522R, which are bilaterally symmetrical and have the same shape, are fixedly provided with the same phase on outsides of the side plates 505L and 505R at left and right end portions of the shaft. The cam 522L is positioned on a lower side of a front end portion of the pressing lever 518L. The cam 522R is positioned on a lower side of a front end portion of the lever 518R.

On a left-side end portion of the shaft 521, a gear (pressure releasing gear) 523 is fixedly provided. To this gear 523, a driving force of a pressing roller demounting and mounting motor (for example, a stepping motor) M2 controlled by the controller 100 is transmitted via a transmitting means (not shown), so that rotation of the shaft 521, i.e., the cams 522L and 522R, is controlled.

That is, the controller 100 causes the motor M2 to rotate in response to a predetermined signal, so that the gear 523 is rotated in a predetermined direction in a predetermined amount. In response to rotation of this gear 523, the shaft 521 is rotated so that the cams 522L and 522R are rotated with this rotation.

By rotation control of the cams 522L and 522R, the levers 518L and 518R are raised and rotated against the spring forces of the springs 519*a* of the spring screws 519L and 519R, so that the pressure of the pad 508 to the pressing roller 22 is changed.

The above-described bearings (not shown), the shaft 521, the cams 522L and 522R, the gear 523, and the motor M2 are, collectively, a changing mechanism for changing the pressure of the nip N by the pressing mechanism 504. Details of a pressure change of the pressing mechanism 504 will be described later.

Pressure Changing Operation

The cams 522L and 522R have two peak shapes as shown in parts (a) and (b) of FIG. 19. A position of the belt 506 when the cams 522L and 522R rotate will be described with reference to parts (a) to (c) of FIG. 20.

Part (a) of FIG. 20 is during a normal pressure mode. During this mode, flat surface portions of the cams 522L and 522R are in an upward rotation angle attitude, so that the cams 522L and 522R are in non-contact with the levers 518L and 518R. For that reason, the spring forces of the springs 519*a* of the spring screws 519L and 519R sufficiently act on the levers 518L and 518R, so that the pressure of the nip N is in a first pressure (normal pressure) state (pressure constitution).

In this embodiment, in the case of the normal pressure mode (first pressing mode), a force (total pressure of the nip) exerted on the heating assembly (belt unit) 501 is 500N. As a normal pressure, 100N to 900N can be applied. The normal pressure may preferably be 40N to 600N.

The cams 522L and 522R rotate in the clockwise direction during the normal pressure mode of part (a) of FIG. 20 and push up the levers 518L and 518R to a first peak (peak 1) position against the spring forces of the springs 519*a* of the spring screws 519R ((a)→(b)). Then, the pressure toward the flange members 510L and 510R is reduced to half thereof, so that the position of the belt 506 is raised by ΔY1 ((a)→(b)). By this arrangement, the pressure mode becomes a predetermined envelope pressure mode (second pressing mode) in which the pressure of the nip N is less than (weak, light pressure) the first pressure during the normal pressure mode (reduced pressure state).

In this embodiment, in the case of the envelope pressure mode, the force (total pressure of the nip) exerted on the heating assembly (belt unit) 501 is set so as to be 30N. As the reduced pressure, 10N to 90N can be applied. The reduced pressure may preferably be 4N to 60N.

When the cams 522L and 522R further rotate and push up the levers 518L and 518R to a position of the highest second peak (peak 2), the belt 506 is raised further by ΔY2. Then, the pressure of the spring forces of the springs 519*a* of the spring screws 519R to the flange members 510L and 510R is disabled, so that the belt 506 and the pressing roller 22 are in a pressure released mode (pressure released state, or pressure released constitution) ((b)→(c)).

The controller 100 controls the heating assembly 501 to the pressure released mode of part (c) of FIG. 20 during stand-by or during non-image formation of the image forming apparatus. In the case in which the sheet passed through the fixing device F is a sheet other than the envelope, the controller 100 controls the heating assembly 501 to the normal pressure mode of part (a) of FIG. 20. Further, in the case in which the sheet is the envelope, the controller 100 controls the heating assembly 501 to the envelope pressure mode (reduced pressure constitution) of part (b) of FIG. 20.

Regarding Pressing Mode

Pressing forms of the fixing device F in this embodiment at the nip N in the normal pressure mode and the envelope pressure mode will be described with reference to parts (a) to (c) of FIG. 21 and parts (a) to (c) of FIG. 22. Part (a) of FIG. 21 and part (a) of FIG. 22 show schematic views when, in each mode, the sheet P (plain paper) other than the envelope passes through the nip N, and part (b) of FIG. 21 and part (b) of FIG. 22 show schematic views when, in each mode, the envelope passes through the nip N. Further, part (c) of FIG. 21 and part (c) of FIG. 22 show a speed distribution on a front-side of the envelope in the case in which, in each mode, the envelope is passed through the nip N.

In the normal pressure mode, as shown in part (a) of FIG. 21, the upstream projected portion 508*a*, the main pressure portion 508*b*, and the downstream projected portion 508*c* of the pressing pad 508, which is a pressure applying member, are in a press-contact state to the belt 506. In the case in which the sheet P other than the envelope is passed through the nip N, the nip N is in an upwardly projected shape by the upstream and downstream projected portions 508*a* and 508*c* of the pad 508, and, therefore, the sheet discharged from the nip N is oriented downwardly. By this arrangement, even in the case in which a sheet having a small basis weight and low rigidity is passed through the nip N, a separating property from the fixing belt 506 is sufficiently ensured.

On the other hand, as shown in part (b) of FIG. 21, when the envelope passes through the nip N in the normal pressure mode, at portions of the envelope that are not constrained on the back and front-sides, the nip N has an upwardly projected shape by the upstream and downstream projected portions 508*a* and 508*b* of the pressing pad 508. For that reason, due to deformation of the envelope passing through the nip N, a difference, in this embodiment, in the amount between the upper surface and the lower surface of the envelope generates.

Part (c) of FIG. 21 shows feeding amounts of a front(-side) feeding amount (solid line arrows) and a back(-side) feeding amount (dotted line arrow) in the case in which the envelope is Long 3. As regards the envelope, paper, including superposed front and back two sheets, is constrained on the front and back sides thereof at least on one edge thereof with respect to a belt widthwise direction. In the case of Long 3 (envelope), positions shown by x are constrained portions. At the constrained portions, the front and back sides are continuous, and, therefore, the envelope passes through the nip N with an intermediary feeding amount between the back and front feeding amounts. Due to a difference in feeding amount with respect to the belt widthwise direction between a constrained portion and a non-constrained portion of this envelope, a rotation moment as shown by white (hollow) arrows generates, so that an envelope crease w generates from a place in which the rigidity of the paper cannot withstand the accumulation of stress.

In this embodiment, an object is such that the nip N is placed in the upwardly projected shape in the normal pressure mode, and, therefore, there is no need that the belt 506 is contacted to all of the main pressure portion 508*b* of the pressing pad 508, and a portion of the main pressure portion 508*b* may only be required to be contacted to the belt 506.

In the envelope pressure mode, as shown in part (a) of FIG. 22, both the upstream projected portion 508*a* and the downstream projected portion 508*c* of the pressing pad 508 are press-contacted to the belt 506, but the main pressure portion 508*b* is in a spaced state from the belt 506. In the case in which the sheet P other than the envelope is passed through the nip N, due to the upstream and downstream projected portions 508*a* and 508*b* of the pressing pad 508 and the rigidity of the belt 506, the nip N does not have the upwardly projected shape but has a straight shape. The sheet to be discharged from the nip N is discharged straightly.

In this case, there is no problem as to the sheet P that includes the superposed two sheets and that has high rigidity as in the case of the envelope, but, in the case in which plain paper P that has a small basis weight and low rigidity is passed through the nip N, curvature of the belt 506 is not sufficiently ensured and a separating property becomes insufficient in some instances.

On the other hand, as shown in part (b) of FIG. 22, when the envelope passes through the nip N in the envelope pressure mode, at portions of the envelope that are not constrained on the back and front-sides, the nip N does not have the upwardly projected shape but has the straight shape. For that reason, deformation of the envelope passing through the nip N is suppressed, so that the difference in feeding amount of the paper between the front and rear (two) sheets of the envelope can be suppressed (part (c) of FIG. 22). By this arrangement, generation of a deviation of a speed with respect to the belt widthwise direction between the constrained portion and the non-constrained portion of the envelope can be prevented.

In this embodiment, a constitution in which, in the envelope pressure mode, as shown in part (b) of FIG. 22, the belt 506 is supported by only the upstream projected portion 508*a* and the downstream projected portion 508*b* of the pressing pad 508 is employed, and a constitution in which the main pressure portion 508*b* does not contact the belt 506 was described.

In the envelope pressure mode, there is also a case that, exceptionally, a portion of the main pressure portion 508*b* contacts the belt 506. For example, the case in which heights of the upstream and downstream projected portions are not sufficient in a mechanical tolerance range and the case in which the heights of the upstream and downstream projected portions are lowered by endurance abrasion exist. Further, in the case in which, in the envelope pressure mode, the envelope having high rigidity passed through the nip N, the belt 506 can deform and contact the main pressure portion 508*b* of the pressing pad 508.

The envelope is originally an envelope on which an envelope crease does not readily generate, however, and, therefore, there is no problem. As the envelope having the high rigidity, for example, an envelope (manufactured by Yamazakura, Co., Ltd. Long 3, end bonding, AR Ultra White 130, no postal code frame, 120 mm×235 mm, basis weight: 130 g/m2) can be used.

Control of this embodiment will be described using a flowchart shown in FIG. 23. First, the image forming apparatus receives an image forming job (JOB). Thereafter, the controller 100 discriminates whether or not the job is an envelope job in which the sheet to be passed through the nip N is the envelope (S5000). When the sheet to be passed is not the envelope, the controller 100 controls the pressure (mode) of the fixing device F to be the normal pressure mode (S5002), and then, an image forming operation and a fixing operation are performed (S5004). In S5000, when the sheet to be passed is the envelope, the pressure mode is changed to the envelope pressure mode (S5001, S5003), and the image forming operation and the fixing operation are performed (S5004).

The fixing operation in the normal pressure mode and the envelope pressure mode will be described using a flowchart shown in FIG. 24. First, the controller 100 causes the pressing roller demounting and mounting motor M2 to drive and adjusts the pressure of the fixing device F to normal pressure (S5100). Then, the controller 100 causes the driving motor M to drive to the pressing roller 22, so that the pressing roller 22 and the belt 506 are rotationally driven, and a voltage is applied to the coil 15 and thus, the belt 506 is heated (S5101). The heating and the rotation are continued until the belt 506 reaches a predetermined (temperature) control temperature (S5102).

In the case in which the mode determined by the flow of FIG. 23 is the envelope pressure mode, the pressure of the fixing device F is switched to the envelope pressure (S5103, S5104). The controller 100 causes the image forming portion to perform the image forming operation, whereby the sheet P, on which the unfixed toner is placed, is introduced in the nip N, and the unfixed toner is fixed on the sheet P (S5105).

Then, the controller 100 performs the operations in S5103 to S5105 until the print job is ended (S5106), and, when the print job is ended, rotation of the driving motor M and electrical power supply to the exciting coil 71 are stopped (S5107). By setting, after the end of the print job, the pressing roller demounting and mounting motor M2 is driven, so that the pressure of the fixing device F is changed to the normal pressure or pressure release (S5108).

The nip widths of the nip N with respect to the sheet-feeding direction Z during the envelope pressure mode and during the normal pressure mode are schematically shown in FIG. 25.

In the normal pressure mode, the nip pad 508 has a crown shape, and, therefore, flexure of the stay 507 and the pressing roller 22 is corrected, so that the nip N can be constituted with a substantially uniform contact nip width for an entire longitudinal region. By this arrangement, uniform sheet separating performance with respect to the longitudinal direction can be ensured for the recording material other than the envelope.

In the envelope pressure mode, at the longitudinally central portion, the contact nip width is broad and thick, but the nip width becomes narrow toward the longitudinal end portion. The nip pad 508 has the crown shape, and, therefore, when the pressing force is weakened, the pressure at the longitudinal end portion decreases, so that the nip width at the end portion becomes narrow. In the envelope, two sheets are superposed, and, therefore, the rigidity becomes high, so that, even in a constitution in which the nip width at the longitudinal end portion is narrow, a sufficient separating property can be ensured.

By using the fixing belt 506 as described above, an effect similar to that in Embodiment 1 is obtained even in a constitution in which the pressure is made variable for meeting the envelope creases. In a constitution in which a heat transfer amount with respect to the longitudinal direction is small as in the fixing belt 506 and, further, the nip width is narrow as in the envelope pressure mode, insufficient heat quantity, particularly at an envelope bonding portion, is liable to occur.

In the envelope pressure mode, the nip width is narrow, so that, in order to make up for the heat quantity, in the flowchart of FIG. 6, the central temperature detecting element 314 was temperature-controlled at 190° C. in S1001, and the rear(-side) temperature detecting element 315 was temperature-controlled at 200° C. in S1002. When the envelope 1 and the envelope 2 were passed through the nip N similarly as in Embodiment 1, a similar effect was obtained.

As described above, even in a constitution in which the pressing force is made variable in the low thermal capacity fixing belt constitution, the fixing belt can be constituted so as not to cause improper fixing and excessively high glossiness.

Other Matters (1) As described above, the case in which bonding is made as in the case in which the sheet is the envelope was described, but it is clear that the present invention is also applicable to a sheet having a difference in heat quantity with respect to the longitudinal direction (widthwise direction) and that a similar effect is obtained. For example, the present invention is applicable to a label paper to which a label is affixed at a longitudinal portion of the label paper.

(2) In the fixing devices F in the embodiments, the pressing pad is pressed toward the pressing roller via the belt, but reversely, a constitution in which the pressing roller is pressed toward the pressing pad via the belt can also be employed. Further, a constitution in which the pressing pad and the pressing roller are pressed toward each other via the belt can also be employed. That is, a constitution in which the pressing pad and the pressing roller are pressed relative to each other via the belt can be employed.

(3) The fixing device F as the fixing portion is not limited to use as a device for heat-fixing, as a fixed image, an unfixed toner image formed on the sheet. The fixing device F is also effective as a device for adjusting a surface property of an image, such as for improving a gloss (glossiness) of an image by re-fixing and re-pressing a toner image fixed once or temporarily fixed on the sheet (such a device is also referred to as the fixing device).

(4) The image forming apparatus is not limited to the image forming apparatus for forming the full-color image as in the embodiments, and may also be an image forming apparatus for forming a monochromatic image. Further, the image forming apparatus can be implemented in various uses, such as a copying machine, a facsimile machine, and a multi-function machine having functions as these machines, by adding necessary device, equipment and casing structure.

INDUSTRIAL APPLICABILITY

According to the present invention, an image fixing apparatus is provided that is capable of carrying out printing in which an image can be properly fixed on an envelope, or the like.

The invention claimed is:

1. A fixing device comprising:

a first rotatable member and a second rotatable member for forming a nip for fixing a toner image on a recording material;

a heating portion for heating said first rotatable member;

a first sensor for detecting a temperature of a longitudinally central portion of said first rotatable member;

a second sensor for detecting a temperature of one longitudinal end portion of said first rotatable member; and a controller for controlling energization to said heating portion based on a detection temperature obtained by said first sensor and a detection temperature obtained by said second sensor in a case that the recording material is an envelope having a predetermined width or more, wherein said first sensor and said second sensor are provided in a sheet passing range corresponding to the predetermined width.

2. The fixing device according to claim 1, further comprising a third sensor for detecting a temperature of the other longitudinal end portion of said first rotatable member, wherein, in a case that the recording material is the envelope having the predetermined width or more, said controller controls energization to said heating portion based on the detection temperature obtained by said first sensor, the detection temperature obtained by said second sensor, and a detection temperature obtained by said third sensor.

3. The fixing device according to claim 2, wherein, in a case that the recording material is an envelope having a width that is less than the predetermined width, said controller controls energization to said heating portion based on the detection temperature of said first sensor, without using the detection temperatures of said second sensor and said third sensor.

4. The fixing device according to claim 2, wherein, in the case that the recording material is the envelope having the predetermined width or more, said controller selects either one of said first sensor, said second sensor, and said third sensor as a sensor to be used for energization control to said heating portion, depending on the detection temperatures of said first sensor, said second sensor, and said third sensor.

5. The fixing device according to claim 4, wherein said controller controls energization to said heating portion based on a detection temperature obtained as a median value of the detection temperatures of said first sensor, said second sensor, and said third sensor.

6. The fixing device according to claim 1, wherein, in a case that the recording material is the envelope having the width that is less than the predetermined width, said controller controls energization to said heating portion based on the detection temperature of said first sensor, without using the detection temperature of said second sensor.

7. The fixing device according to claim 1, wherein, in a case that the recording material is not the envelope having the predetermined width or more, said controller controls energization to said heating portion based on the detection temperature of said first sensor.

8. The fixing device according to claim 1, wherein said controller controls energization to said heating portion based on the detection temperature of said first sensor.

9. A fixing device comprising:

a first rotatable member and a second rotatable member for forming a nip for fixing a toner image on a recording material;

a heating portion for heating said first rotatable member;

a first sensor for detecting a temperature of a longitudinally central portion of said first rotatable member;

a second sensor for detecting a temperature of one longitudinal end portion of said first rotatable member;

a third sensor for detecting a temperature of the other longitudinal end portion of said first rotatable member; and a selecting portion for selecting either one of said first sensor, said second sensor, and said third sensor as a sensor to be used for energization control to said heating portion, depending on detection temperatures of said first sensor, said second sensor, and said third sensor in a case that the recording material is an envelope having a predetermined width or more, wherein said first sensor and said second sensor are provided in a sheet passing range corresponding to the predetermined width.

10. The fixing device according to claim 9, wherein, in a case that the recording material is an envelope having a width that is less than the predetermined width, said selecting portion selects said first sensor as the sensor to be used for the energization control to said heating portion.

11. The fixing device according to claim 9, wherein said controller controls energization to said heating portion based on a detection temperature obtained as a median value of the detection temperatures of said first sensor, said second sensor, and said third sensor.

* * * * *